US009629429B2

(12) United States Patent
Green

(10) Patent No.: US 9,629,429 B2
(45) Date of Patent: Apr. 25, 2017

(54) RETRACTABLE WHEEL MECHANISM

(71) Applicant: The Pukka Luggage Company Limited, London (GB)

(72) Inventor: Stephen Green, Milton Keynes (GB)

(73) Assignee: The Pukka Luggage Company Limited, London (GB)

( * ) Notice: Subject to any disclaimer, the term of this patent is extended or adjusted under 35 U.S.C. 154(b) by 0 days.

(21) Appl. No.: 14/783,009

(22) PCT Filed: Apr. 4, 2014

(86) PCT No.: PCT/GB2014/051058

§ 371 (c)(1),
(2) Date: Oct. 7, 2015

(87) PCT Pub. No.: WO2014/167296

PCT Pub. Date: Oct. 16, 2014

(65) Prior Publication Data

US 2016/0045000 A1 Feb. 18, 2016

(30) Foreign Application Priority Data

Apr. 9, 2013 (GB) ..... 1306426.6

(51) Int. Cl.
*A45C 5/14* (2006.01)
*A45C 13/26* (2006.01)

(52) U.S. Cl.
CPC ..... *A45C 5/146* (2013.01); *A45C 13/262* (2013.01)

(58) Field of Classification Search
CPC ..... A45C 5/14; A45C 3/001; A45C 13/262; A45C 13/385; A45C 5/146; A45C 5/16; B62B 1/22; B62B 1/125
See application file for complete search history.

(56) References Cited

U.S. PATENT DOCUMENTS

| | | | | |
|---|---|---|---|---|
| 3,842,953 A | | 10/1974 | Royet | |
| 3,960,252 A | | 6/1976 | Cassimally | |
| 4,087,102 A | * | 5/1978 | Sprague | A45C 5/146 16/113.1 |
| 4,273,222 A | * | 6/1981 | Cassimally | A45C 5/146 190/18 A |
| 4,314,624 A | * | 2/1982 | Royet | A45C 5/146 16/113.1 |
| 4,761,012 A | * | 8/1988 | Dames | A45C 13/385 190/18 A |
| 4,917,392 A | * | 4/1990 | Ambasz | B62B 1/125 280/40 |

(Continued)

FOREIGN PATENT DOCUMENTS

| | | |
|---|---|---|
| DE | 19 82 824 | 4/1968 |
| FR | 2 466 212 | 4/1981 |

(Continued)

*Primary Examiner* — Hau Phan
(74) *Attorney, Agent, or Firm* — Blank Rome LLP

(57) ABSTRACT

A wheel retraction mechanism for use on travel luggage, the retraction mechanism causing the extension and retraction of one or more wheels upon relative movement of two adjacent members. The members comprise two engaging actuation surfaces which, upon relative longitudinal movement, create a movement in a different direction, which can be used to extend or retract wheels from a piece of travel luggage.

45 Claims, 15 Drawing Sheets

(56) References Cited

U.S. PATENT DOCUMENTS 5,127,662 A * 7/1992 Spak ..... B62B 1/125 280/40
5,249,438 A * 10/1993 Rhaney ..... A45C 5/14 16/113.1
5,253,739 A * 10/1993 King ..... A45C 13/262 190/115
5,403,023 A * 4/1995 Tsai ..... A45C 13/385 280/42
5,476,163 A * 12/1995 Wu ..... A45C 13/262 16/113.1
5,833,039 A * 11/1998 Kotkins, Jr. ..... A45C 3/001 16/405
5,873,439 A * 2/1999 Liang ..... A45C 5/14 16/34
6,082,510 A * 7/2000 Liang ..... A45C 5/14 16/34
6,612,411 B2 9/2003 Nykoluk et al.
7,500,680 B2 3/2009 Dayton et al.
8,757,643 B2 * 6/2014 Arthur ..... A45C 5/146 16/34
D758,076 S 6/2016 Boer
2001/0032765 A1 10/2001 Tiramani et al.
2004/0000457 A1 * 1/2004 Sanford-Schwentke A45C 13/262 190/18 A
2004/0163910 A1 * 8/2004 Lee ..... A45C 5/146 190/18 A
2006/0011499 A1 1/2006 Yen
2009/0160147 A1 * 6/2009 Arthur ..... B62B 1/22 280/35
2010/0025174 A1 * 2/2010 Dayton ..... A45C 13/262 190/18 A

FOREIGN PATENT DOCUMENTS

FR 2948265 1/2011
GB 1099200 1/1968
GB 1 479 136 7/1977
GB 2 245 250 A 1/1992

* cited by examiner

RETRACTABLE WHEEL MECHANISM

BACKGROUND OF THE INVENTION

1. Field of the Invention

The current invention relates to a mechanism that enables wheels attached to luggage or other such items to be retracted, thus saving space when not in use.

The invention allows wheels to be attached to an item and used as normal, often in conjunction with a handle, for making the movement of bulky items easier. The invention then enables the user to easily retract the wheels so they no longer protrude from the item, allowing it to be easily and compactly stored.

2. Description of the Related Art

Over recent years with the increase in awareness of risks associated with lifting and carrying heavy or bulky items, more suitcases and other such items are manufactured with integrated wheels. Although not always, these wheels usually protrude from a bottom edge of the item with a handle provided on a top edge to rock the item onto the wheels and pull it along.

As such, the wheels often end up wasting a disproportionate amount of space compared to their size when the item is in need of being stored either in a confined space (such as an overhead locker on an aeroplane) or when a large number are being stored together (for example supply transportation). This makes the prospect of being able to retract the wheels into the item to reduce the amount of space wasted very attractive to producers and designers, as they would then be able to utilise more of the space taken up by the item.

Further, significant time, effort and therefore expense is put in to the aesthetics of travel luggage. There is little scope for modifying the appearance of wheels attached to these items of luggage, and as such, the aesthetics of most travel luggage items is affected by the addition of clunky, bland and often dirty wheels. It would thus be desirable for the wheels to be concealed when not in use, thus improving the appearance of the luggage, and giving designers more freedom during the design stage.

The problem is that as of yet there has not been a satisfactory design to achieve this goal. Many devices enable the retraction of wheels using a variety of mechanisms. These mechanisms are often located adjacent to the wheel, and hence close to the ground. This leads to problems with the ingress of dirt and water from the floor into the mechanism which can cause wear, increased stiction and ultimately premature failure.

Such mechanisms also therefore often require the user to directly interact with the wheels. This is both awkward and time consuming as users are forced to upend their luggage or other item and manually retract the wheels. In certain situations this is undesirable as the user may be in a rush, may be in a confined space, for example on an aeroplane, the bottom of the item may be dirty or wet or it may simply be too heavy to lift and manoeuvre Another factor and important limitation on the durability and robustness of current solutions is the complexity of the design; quite often such devices comprise a number of moving parts, hinges and other dynamic components such as in U.S. Pat. No. 4,575,109, the whole contents of which are incorporated by reference. Generally, the higher the number of components and connections the less robust and durable the design.

Further, current retraction mechanism designs often take up a large amount of space, this then either protrudes from the luggage or item, making it quite unwieldy, or is located inside the luggage or item, thus detracting from the space for the luggage or item itself. This negates the benefit of having a method to retract the wheels to save space.

SUMMARY OF THE INVENTION

The present invention seeks to improve upon such existing designs by providing a mechanism for enabling wheels to be retracted, whereby: the size of the mechanism is kept to a minimum, and is in fact in certain embodiments contained within conventional components; the design is kept simple and robust; and the location and nature of the invention is such that it makes operating the invention easy—being operable without having to interact with the wheels directly—and in fact being automatic upon retraction of the handle of the item.

While many current products allow users to roll their luggage on integrated wheels, and some current designs even allow the user to retract these wheels upon arrival, none provide as easy, efficient or convenient a solution as the present invention. With the present invention the wheels of the luggage or item can be retracted automatically upon returning the extendible handle to its housing. As such the user is not required to spend any additional time retracting the wheels, and also does not need to bend down or lift the luggage or item to be able to retract the wheels. Additionally the retraction mechanism can be extremely robust, and so need not limit the usable life of the luggage or item.

The present invention also allows the wheels to be concealed when not in use, greatly improving the aesthetics of the bag when not being pulled on the wheels. There is a large scope of different methods of concealing the wheels, and this provides a large amount of flexibility for the designers. Further advantages of the present invention will become apparent as further features of the present invention are described.

Throughout this application reference is made to "travel luggage". Unless explicitly stated otherwise, in the context of this application travel luggage is thought to incorporate any luggage with at least one of the following features:

- it can be completely closed;
- it can lie flat on one of its larger faces; and
- it has an opening that extends for substantially the whole extent of the luggage along its largest axis.

According to the present invention is a wheel retraction mechanism for wheeled luggage, comprising: a primary member, the primary member defining a first actuation surface in an elongated surface; a secondary member, located substantially parallel to the primary member, the secondary member having a projection extending therefrom; at least one wheel, attached to the primary or the secondary member; wherein the second actuation surface engages the first actuation surface and is shaped so it is able to slide along the length of the first actuation surface, and the first actuation surface is shaped whereby relative longitudinal motion between the primary and secondary members results in rotation of at least one of the primary and the secondary members about its longitudinal axis.

Preferably the first or second actuation surface is generally thin and preferably elongate, preferably the other connecting actuation surface engages, grips or hooks on to the elongate actuation surface. Thus the connecting actuation surface generally moves along at least part of the length of the elongate actuation surface, actuating the rotation.

The primary and secondary members provide the two main, and in some cases only components of the mechanism.

The members are generally adjacent each other and interact via the first and second actuation surface, the members are generally elongated and may be cylindrical, although the present invention is not limited to such designs. Other possible cross sections for such members are square, rectangular or any other suitable cross section. The members are preferably tubular although the invention is not limited as such.

The first actuation surface and second actuation surface arrangement acts as a guide and produces the rotational movement from the lateral movement input. Preferably, the first and second actuation surface comprises a slot and a projection. It is to be understood that the language used also covers a variety of other features that when combined would produce the same effect. Examples of other suitable features would be a groove and a protrusion, two interlocking hooks/fingers, or a series of channels and ball bearings or rollers. Other suitable substitutes would be apparent to one skilled in the art. Furthermore, the term projection is specifically used to cover items such as dowels or screws, as well as items welded on to the surface of the member, or even brackets or other components specifically attached to the member to perform the function as described. Actuation surfaces should be interpreted in a broad sense, to incorporate any such feature which would fulfil the requirements outlined in this document.

At least one actuation surface is preferably separable from their respective members if practicable. For example, if a slot and projection is utilised on the primary and secondary member respectively, preferably the projection is separable from the secondary member, although it may also be a fixed part of a single, secondary member. The actuation surface (e.g. projection) is preferably screwably detachable from the secondary member, although it may also slide in and out of position.

It is also to be understood that when the first and second actuation surfaces comprise a slot and a projection, or equivalent means, when the language herein refers to the projection sliding along the length of the slot, it is not necessarily meant in the strict literal sense of the projection sliding along the entire length of the slot. The language also covers situations whereby the projection slides some or partway along the slot. The slot is also not limited to extend in a single flat plane, and so the length of the slot does not refer to a single constant vector, and may instead vary along the slot.

The wheel and its respective housing or bracket may be permanently and rigidly attached to the device, or alternatively may be detachable and constrained only as to translational movements, thus able to rotate relative to the member to which it is mounted. The current invention may be used with any number of wheels and may also be used independent of any wheels. While wheels are generally referred to herein to give context to typical uses it is foreseeable that such an invention is equally applicable to uses that do not involve wheels. For example skids, pads or rollers are equally applicable.

As stated above the first and second actuating surfaces are configured to generate rotational movement from longitudinal movement. Equally the first and second actuating surfaces may be used to produce lateral movement in one vector to lateral movement in another plane, and such uses are thought to be within the scope of the present invention. For example it is foreseeable that should the primary member be rectangular with a slot in one of its long flat sides in a vertical plane with the slot lying at an angle to its long edges, horizontal movement of the secondary member with a finger mated with the slot would also produce a vertical movement of the secondary member.

Preferably, both the primary and secondary members are tubular and the first actuation surface is helically shaped around the length of the elongated surface of the primary member.

Preferably, both the primary and secondary members are made of a light-weight but rigid, strong and durable metal. However, other potential materials could also be used, such examples include rigid plastics and composites.

A helical first actuation surface is preferable as it provides the simplest and smoothest method of creating the rotational movement as the two members are moved longitudinally relative to each other. Other first actuation surface shapes, such as a path that appears straight when observed from the side would also be able to actuate the required rotation.

More preferably, the actuation path is an irregular helical shape, which comprises a first and last section which extend substantially parallel to the longitudinal axis of the primary member, and a middle section which comprises a more pronounced "turn", and hence has an increased angle with respect to the longitudinal direction of the respective member as compared to the first and last portion. Upon actuation of the primary and secondary members, the members do not rotate relative to each other for the first and last sections of the movement, but rotate more rapidly during the middle segment. This is found to be a more useful movement when the wheels are required to withdraw from behind a cover (as discussed later) as the wheels do not rotate much until the cover is partially withdrawn.

Preferably, the primary member and the secondary member are co-axial. Preferably they are adjacent one another. They may be separated from one another by a distance which is not more that the width of one of the primary member or the secondary members. In this way, they can support one another. Preferably, one of the primary member or the secondary members is at least partially disposed within the other of the primary member or the secondary member. Thus the outer member (at least) is required to be tubular, at least partially housing the inner member. Preferably there is a sliding fit between said primary member and said secondary member.

Although circular members are the most obvious and effective choice, other, and in fact any, shapes of member are foreseen as being according to this invention, provided a sufficient gap is provided between the members to allow the inner member to rotate within the outer. Such an arrangement produces a compact design and easily facilitates the relative rotation of the members. Additionally, this has the benefit of the majority of the mechanism for retracting the wheels being inside these two members, thus keeping them largely concealed from dirt and debris.

Preferably, a non-rotating member comprises one of said primary member or said secondary member and is unable to rotate (or is prevented from rotating) about a longitudinal axis, and a rotating member comprises the other of said primary member or said secondary member and is free to rotate about its longitudinal axis. Thus, as one member is constrained from rotating, any relative rotation of the two components due to the interaction of the first and second actuating surfaces during longitudinal movement manifests itself in a rotation of the rotating member.

Preferably, when in a fully extended state, a bracket or bearing attached to one of the rotating or non-rotating members, or a component of the member itself, abuts a similar feature on the other of the rotating or non-rotating member, thus when a force is exerted on the non-rotating member in a longitudinal direction, forcing the second actuation surface against the end of the first actuation surface, these brackets or components transfer a proportion of the force, thus preventing the second actuation surface or first actuation surface from becoming deformed or broken.

Preferably, the at least one wheel is attached to said rotating member. Preferably the wheel is attached to the rotating member, and so the wheel is rotationally actuated upon relative lateral movement. As such it is preferable if the rotating member is constrained to prevent lateral motion, and the non-rotating member, is free to move laterally to provide the longitudinal movement. This creates a mechanism whereby one concentric tube is withdrawn relative to the other one, and as it does so, the second tube rotates.

Preferably, the at least one wheel is configured so that when in a retracted position, it is withdrawn from the outer circumference of the luggage and is located in a pouch, channel, recess or compartment. Preferably the plane of the wheel is located parallel to the surface of the recess, thus minimising the depth of recess or compartment required.

This design is perfectly suited for luggage applications wherein the non-rotating member can comprise or be attached to a handle, and so the withdrawal of the handle actuates the extension or retraction of the wheels.

Preferably, upon movement of the second actuation surface along the length of the first actuation surface, said rotating member is rotated between a position where the wheel or wheels are fully extended and a position where the wheels are fully retracted.

Thus it is preferable that in use the wheels are at their fully extended position and are operational. Then when desired, the user can operate the non-rotating member, preferably connected to a handle, rotating the rotating member and wheels to a retracted position, preferably at around 90 degrees from the extended position. Preferably this retracted position corresponds to the wheels being housed within a recess in the luggage or item.

Preferably, the rotation required to move the wheel or wheels from a fully extended to a fully retracted position is between 70-110 degrees. Depending on the angle of the wheels in the retracted position, this allows the extended wheels to extend at an angle of less than 90° relative to the ground. This will result in the weight of the luggage forcing the wheels in an expanding direction; this negates the risk of a bump or knock from the side forcing the wheels to retract.

Preferably, there is a sliding fit between the primary member and the secondary member.

In one potential embodiment there is an inner member and an outer member and the outer member is rotatably mounted on the item or luggage and is the rotating member attached to the wheel, here the inner member is non-rotating and is moved in and out of the rotating member along their common axis.

In a potential embodiment the inner member is the rotating member and is attached to the luggage or item and the non-rotating member is an outer tube. There are a number of other different configurations of such an arrangement, all will be apparent to one skilled in the art and in all designs the first and second actuation surfaces may be located interchangeably on either member.

Where the non-rotating member comprises the handle of the luggage, the overall design takes up no additional space compared to a standard design with a retractable handle.

Further, it is possible in some embodiments to have the first and second actuating surfaces located entirely within the confines of the outer surface of the outer member.

Hence, the actuating surfaces are not open to the ingress of dirt and liquids which may affect their performance.

Preferably, when the second actuation surface is at a location corresponding to a retracted position, one of the primary or the secondary members is located almost wholly within the other of the primary member or the secondary member. This again means the mechanism is as compact as possible.

Preferably, the first actuation surface extends over at least half the length of the primary member. Preferably, the first actuation surface extends over substantially the entire length of the primary member. The longer the first actuation surface is, the more gradual the gradient and the smoother and gentler the rotation of the rotating member can be.

Preferably, the first actuation surface is a slot, and the second actuation surface is a projection for engaging the slot.

Preferably, a first end portion of the first actuation surface runs substantially parallel to the longitudinal axis of the primary or secondary member. Preferably, the second end portion of the first actuation surface runs substantially parallel to the longitudinal axis of the primary or secondary member. Preferably, a centre portion of the first actuation surface has an increased angle with respect to the longitudinal direction compared to both the first and second end portions of the first actuation surface.

Such an actuation surface design results in smooth rotation, but also provides further advantages: a substantially parallel section at the beginning means there is less rotation as the user initially starts moving the non-rotating member (i.e. withdrawing the handle of a suitcase). This allows an amount of momentum to be built up before the wheels are actuated. Also, if the non-rotating member is a handle, and provides a cover for the wheels as described below, it allows the cover to be withdrawn out of the path of wheels, before they are extended, thus preventing the mechanism from being jammed or the wheels from being damaged.

A section substantially parallel to the longitudinal direction of the members at the second end of the actuation surface can help prevent the case being damaged before the wheels are fully extended. In general, when using an item of travel luggage with wheels, the user withdraws the handle and tilts the luggage on to the wheels in one combined motion. As such, when using the present invention as the handle of an item of travel luggage, it is desirable to have the wheels in an extended and usable position, before the handle is fully extended, thus making sure no damage is done as the weight of the case is transferred on to partially-extended wheels or the corner of the case itself. Providing a parallel section of the actuation surface at the second end of the actuation surface can provide this.

Preferably the above description will relate to the slot of an actuation surface, but it is equally applicable to other actuation surface combinations.

Preferably, the wheel retraction mechanism is attached to an item of travel luggage.

Preferably, the wheel retraction mechanism is attached to a side of the travel luggage which can be used as a base to stand the luggage on. Alternatively, the wheel retraction mechanism may be attached to a side of the luggage adjacent the base and when in a wheel-extended position, the luggage can be leant on to the extended wheels to be transported.

Preferably, the wheel retraction mechanism is attached to a side of the travel luggage which is opposite an opening in the luggage.

Due to the simplicity and compactness of the present invention, the wheel retraction mechanism can be used in a variety of types of travel luggage, and may even be used for applications outside those of travel luggage. Preferably the travel luggage has a compartment in which the retracted wheels can be stored. Preferably this compartment is recessed from the surface of the travel luggage. Preferably this compartment is capable of being covered, and so the wheels are not visible when not in use. Preferably the compartment cover is rigid and comprises or is covered in an aesthetically pleasing material. Preferably this cover matches the rest of the travel luggage. Preferably the non-rotating member is also concealed when the wheels are retracted. Preferably the travel luggage can be rested on the surface containing the non-rotating member and/or wheels.

The travel luggage can comprise a rigid case, or a bag made out of a flexible material. A variety of sizes of luggage can contain the present invention, from a small hand-luggage size, to a much larger family-suitcase sized item. Capacities can therefore vary greatly, from a small bag of around 10 to 15 liters, up to a large case of 100 to 150 liters.

The luggage could be made out of woven fabrics, flexible or rigid plastics, composites or even metals, depending on the style of luggage. There is a large amount of freedom as to the dimensions of the present invention, and so this allows a large amount of design freedom in relation to the shape and size of any luggage to which it is attached. While standard rectangular items of luggage are the most obvious design, the present invention may be attached to luggage of other shapes, for example hemispherical prisms.

Preferably, the rotating member is rotatably attached to the luggage. An example of an attachment method to achieve this is to house the rotating member in bearings which are fixed to the luggage. There are, however, a number of ways of achieving this. It is desirable that the rotating member turns freely with as little friction as possible.

Preferably, the or each wheel is attached to the rotating member by a bracket, which rotatably fixes the wheel or wheels relative to the rotating member a distance away from the longitudinal axis of the rotating member. The wheel should be pivotally connected at its axle/hub and thus free to rotate about its axis. However, it is preferable that the wheel is displaced from the rotating member so when the wheel is in its extended state, it protrudes from the luggage, resulting in the luggage being lifted somewhat from the floor in use. This prevents the luggage from getting dirty and enables the luggage to be bumped up small steps without damaging the contents.

Preferably, a first bearing surface is provided in one of the rotating or non-rotating members, the first bearing surface engaging a second bearing surface provided in the luggage or a fitting attached thereto for transferring load in a direction parallel to the longitudinal direction of the rotating and non-rotating members.

The first bearing surface and second bearing surface are separate and independent from the first actuation surface and second actuation surface. The first bearing surface may be located anywhere on the primary or secondary member. Preferably the first bearing surface is located on the primary member, however the alternative is equally relevant to the present invention. Preferably the second bearing surface mates with the first bearing surface. Preferably the first bearing surface and second bearing surface are located near the wheel or wheels. This ensures that weight is transferred to the wheels over a relatively short distance making the arrangement more robust.

The second bearing surface is either part of, or attached to the luggage. Preferably the second bearing surface is a projection which projects, for example, from a small plate attached to the luggage. The small plate could be riveted, screwed, glued or sewed to the luggage, provided the attachment means is strong. Alternative arrangements, such as the second bearing surface being integral to the luggage, are envisaged. The second bearing surface will transfer a portion of the load of the luggage to the rotating member, and so should be designed accordingly. Thus if the second bearing surface is tubular, thick walls will be required and radiused corners are desirable. Equally, the first and second bearing surface could be the upper and lower races of a thrust bearing, a ball and socket joint or any other suitable component.

Preferably the first bearing surface is located in the rotating member. And preferably, the first bearing surface and second bearing surface transfer the majority of the load of the luggage to the rotating member.

This first bearing surface and secondary bearing surface are for safely transferring the load of the case to the rotating member without unacceptable pressure concentrations leading to deformations or breakages. Preferably, the first bearing surface and second bearing surface are of a design suitable for safely transferring loads of over 10 kg, more preferably the design can transfer loads of over 15 kg, 20 kg or even over 25 kg.

Preferably, the first bearing surface is orientated in a circumferential direction of the rotating member. This allows the second bearing surface to traverse the first bearing surface as the rotating member rotates relative to the luggage (the rotating member does not move laterally relative to the luggage, and so a helical bearing surface is not required).

Preferably, the second bearing surface slides substantially along the length of the first bearing surface as the rotating member rotates between its wheel-extended and wheel-retracted position. More preferably, the second bearing surface abuts a surface of the first bearing surface when the rotating member is in its wheel-extended position, preventing the rotating member from rotating any further.

As well as transferring luggage-load, the first bearing surface and second bearing surface act to secure the wheels and prevent forces acting on the side of the wheels forcing them to over-rotate, potentially damaging or breaking the generally smaller first actuation surface and second actuation surface. When in a wheel-retracted state, the second bearing surface preferably abuts the other end of the first bearing surface. As such, the first bearing surface has to extend circumferentially for the same amount of rotation as the first and second actuation surfaces dictate.

Preferably the first and second bearing surfaces comprise a slot and lug or projection respectively. Preferably the slot and lug or first and second bearing surfaces are designed to only engage each other when the wheels are in a fully extended position. Preferably the first and second bearing surfaces engage each other when the wheels are in a fully extended position, and act to prevent the wheels from rotating further, past a fully engaged position. If the first and second bearing surfaces comprise a slot and projection and are designed to only engage each other as the wheels reach a fully extended position, frictional resistance of this component is minimised, and in some cases eliminated during rotation of the rotating member, right up until the point of engagement. Furthermore, this design is simpler and therefore cheaper than using a standard thrust bearing.

Preferably a further component, a reinforcing member, is connected to the luggage and interacts with a locking projection on the rotating member when the rotating member is in the wheel-extended position, preventing the rotating member from rotating to a wheel-retracted position without the second actuation surface being moved along the first actuation surface.

The locking projection, located on the rotating member can be a dowel, welded on a step, ball or any other projection which can act to abut against the reinforcing member, preventing the rotating member from rotating.

The reinforcing member is to prevent the wheel or wheels forcing the rotating member to rotate back in to a wheel-retracted position, when the wheels are deployed. As such, the reinforcing member needs to prevent the rotating member from rotating when the wheels should be extended (i.e. when the non-rotating member is extended and the second actuation surface is in the extended position), but allow the rotating member to rotate when the second actuation surface moves towards the wheel-retracted position.

As such, it is preferable that the reinforcing member is slidably attached to the luggage, and it is more preferable that the reinforcing member is moved by the second actuation surface or a bracket attached thereto, from a first position, wherein the locking projection does not interact with the reinforcing member when the rotating member is in a wheel-retracted position, to a second position, where the locking projection does interact with the reinforcing member when the rotating member is in a wheel-extended position.

This provides that as the second actuation surface is moved to an extended position, it engages or interacts with the reinforcing member, causing it to slide in to a position where it abuts the locking projection as the rotating member reaches the extended position. When in this position, the second actuation surface is maintained in position by locking pins (as discussed below), the second actuation surface keeps the reinforcing member in position, which in turn prevents the rotating member from rotating in a retracting-direction.

This, coupled with the use of a second bearing surface and slot means that when in an extended position, the wheel or wheels are fixed, and are unable to rotate either in a retracting or extending direction without the non-rotating member being moved back in to a retracting position.

The locking projection may be arranged so that when the rotating member is in an extended state, the locking projection projects substantially perpendicularly to the panel (or side) of the luggage to which the reinforcing member is attached. The locking projection may be arranged such that when the rotating member is in an extended position and forced in a wheel-retracting direction, the locking projection exerts a force on the reinforcing member substantially parallel to the panel of the luggage to which the reinforcing member is attached.

The reinforcing member may comprise an engaging panel.

The engaging panel may lie in a plane which lies substantially parallel to the plane of the luggage-panel to which the reinforcing member is attached. The engaging panel may be substantially "L" shaped. Alternatively, the engaging panel may be substantially "U" shaped.

When the rotating member is moved into an extended state and hence the reinforcing member is moved into an extended (and therefore engaging) position, the engaging panel may interact with, or engage the locking projection. The engaging panel may restrain movement of the locking projection. The locking projection may be arranged such that when the rotating member is in an extended position and forced in a wheel-retracting direction, the locking projection exerts a force on the engaging panel parallel to the plane of the engaging panel.

An embodiment according to some aspects of the present invention may comprise two reinforcing members. The two reinforcing members may be arranged so as to be mirror images of each other. The two reinforcing members may be arranged so that any forces exerted on them by their respective locking projections act equally, in opposite directions.

A linking member may connect a first and a second reinforcing member. The reinforcing members may be arranged such that the linking member transfers force acting on one reinforcing member to the other. The reinforcing members and linking member may be arranged such that forces acting upon both reinforcing members are opposed, so that they can cancel each other out. The linking member may be subject to equal and opposite forces at each end, where it is connected to each reinforcing member.

Preferably, the reinforcing member slides from its second position (a blocking position) to its first position (a non-blocking position) under the action of a spring, as the second actuation surface moves along the first actuation surface, allowing the rotating member to rotate to a wheel-retract position.

Upon movement of the second actuation surface in a retracting direction, the reinforcing member is no longer held in the second position. As such, it is preferable that a spring slides the reinforcing member into the first position (a non-blocking position) as the second actuation surface moves, allowing the rotating member to rotate. Additionally this again highlights the benefit of having a relatively flat and parallel section at the two ends of the first actuation surface. This allows the reinforcing member to move out of a blocking position before the rotating member starts to rotate, preventing the mechanism from jamming.

Obviously a sliding reinforcing member is not the only possible solution. A further possibility is a spring-biased wedge reinforcing member, whereby the locking projection slides over the angled face of the wedge as the rotating member rotates, then as the rotating member reaches the extended position, the locking projection reaches the end of the wedge and the wedge clicks down towards the rotating member under the action of the spring, whereby the locking projection abuts the side face of the wedge, preventing the rotating member from turning back in a retracting direction. The spring-biased wedge reinforcing member could then be retracted by the use of the button which actuates the locking pins to allow the locking projection to pass.

Referring now to the locking pins, preferably, at least one hole in either the rotating or non-rotating member engages with a retractable projection when the rotating member is in a wheel-retracted position, thus locking the mechanism in this position. Although the term locking pin is used, many equivalents would be apparent to the skilled reader. Preferably, at least one hole in either the rotating or non-rotating member engages with a retractable projection when the rotating member is in a wheel-extended position, thus locking the mechanism in this position. Such locking pins or equivalents enable the non-rotating member to slide and lock in to place automatically upon reaching either extent of its movement.

The location and size of these locking pins is arbitrary, as is on which member the hole and the projection is located. However, preferably there are multiple holes and projections (locking pins) and preferably they are located in the vicinity of either end of the rotating member. Preferably the hole is located on the non-rotating member and the retractable projection on the rotating member.

Preferably the at least one hole and retractable projection fix the relative positions of the rotating remember and the non-rotating member, thus maintaining the second actuation surface in a position where it keeps the reinforcing member in its second position, thus engaging the locking projection.

Preferably, the retractable projection or retractable projections retract against the action of a spring. This provides that the locking pins automatically engage and lock the non-rotating member relative to the rotating member.

Preferably, the retractable projection or retractable projections retract under the action of a button. Hence the action of the button moves the retractable projection, or pins, in a direction against the action of the spring, in to a retracted position, thus disengaging it/them from the hole/holes. This then allows the two members to be moved relative to each other.

Thus, depression of the button releases the non-rotating member which can then move relative to the rotating member in either a retracting or extending direction.

Obviously, multiple alternatives to a button may be readily substituted, a button is however believed to be preferable due to its ergonomics, aesthetic appeal and practicality. Possible alternatives would be readily apparent to a skilled reader, but include a lever, a pull cord or a twisting fixture/knob.

Preferably a cover is attached to the non-rotating member. Preferably this cover comprises a panel which aesthetically matches the luggage. Preferably this cover is made of a strong and durable material and is rigid. Examples of potential materials include plastic, metal or composites, preferably coated with material, leather or other textiles. Preferably when the wheels are in a retracted position, this cover encloses and protects the wheels from damage and dirt. Preferably this cover extends over the entirety of the recess and compartment. More preferably, when the wheels are in a retracted state and located behind the cover, the fact that the luggage comprises a compartment or retractable wheels is not visually evident.

Preferably, the cover conceals the wheels when the wheels are in a retracted position.

Preferably, the second actuation surface is cylindrical in shape. Although any polygonal cross-sectioned projection could be used according to this invention, a circular cross section is preferable as it minimises friction and stress concentrations while sliding along the first actuation surface. As such, wear, damage and the risk of the mechanism jamming is reduced.

Preferably, the second actuation surface is detachable from the secondary member. This would allow the second actuation surface to be replaced if damage, as well as maintained (e.g. cleaned and greased) to extend the life of the mechanism.

Preferably, the second actuation surface is screwably detachable from the secondary member. This ensures a secure attachment of the second actuation surface, alternatives are however envisaged, for example a projection which simply slides or clicks in to place.

Further according to the present invention is an apparatus comprising two or more wheel retraction mechanisms as described above, attached to a common component, wherein said non-rotating members are interconnected and thus unable to rotate along their longitudinal axes. This provides an elegant method of preventing the two non-rotating members from rotating.

More preferably, the common component acts as a handle for the user. Even more preferably, the handle comprises the button for retracting the retractable projections. This provides a strong and secure handle system, with an integrated wheel-retraction mechanism, the handle acting to increasing the rigidity of the system as a whole, prevent the non-rotating members from rotating (thus forcing the rotating members and wheels to rotate) and increase the strength and robustness of the wheel retraction mechanism.

Alternatively, the common component could be a cover, or a cover and a handle. This would present all the combined advantages of having a handle and cover as described above.

For example, the cover may act to conceal and protect the wheels when in a retracted position.

Further according to this invention is the use of a wheel retraction mechanism as described above on an item of luggage.

BRIEF DESCRIPTION OF THE DRAWINGS

The present invention will now be described, purely by way of example, with reference to the accompanying drawings.

DETAILED DESCRIPTION OF THE INVENTION

Figure 1:
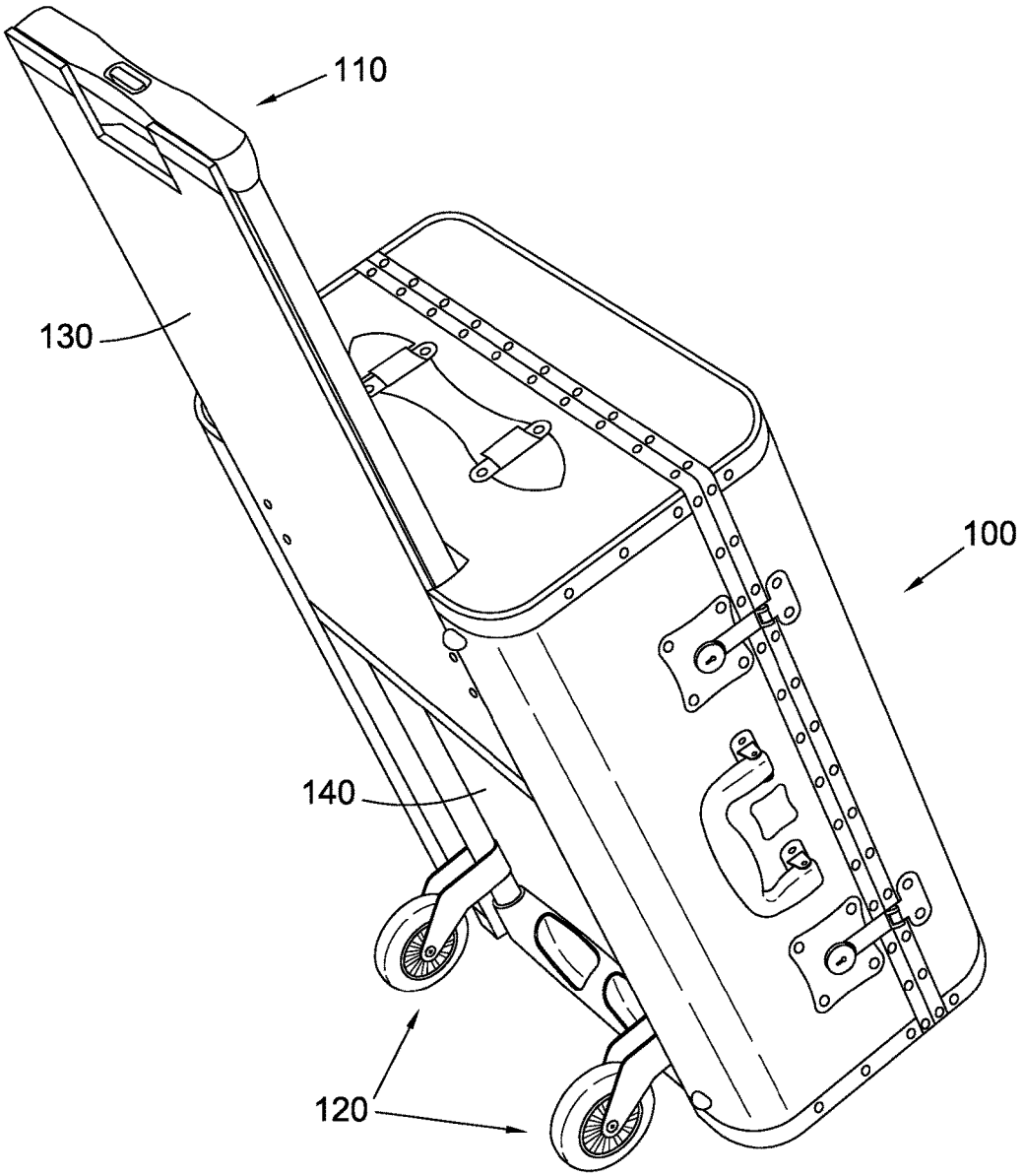
FIG. 1 is a perspective view of luggage using a wheel retraction mechanism according to the present invention in an in-use position.

A specific embodiment of the present invention will now be described in detail with reference to the figures.

The following reference numerals are used in the detailed description:

100—Item of luggage

110—Extendible handle

120—Retractable wheels
130—Cover
140—Compartment
150—Non-rotating member
160—Crossbar
170—Rotating members
180—Wheel bracket
190—First slot
200—Secondary slot
210—Retractable pin
220—Hole (upper)
230—Hole (lower)
240—Wheel
250—Button
260—Bracket assemblies
270—Wheel housing
280—Load bearing projections
290—Plate holes
300—Supporting brackets
310—Reinforcement member
320—Blocking projection
330—Screws
340—Slots
350—Tab
360—Blocking panel
370—Spring
400—Alternative reinforcement member
410—Screw
420—Slot
430—Blocking projection
440—Spring
450—Tab
460—Engaging panel
470—Linking member FIG. 1 shows an item of luggage 100 with an extendible handle 110 and retractable wheels 120. Further, it can be seen that the handle 100 comprises a cover 130, which, when in a retracted position closes a compartment 140.

Figure 2:
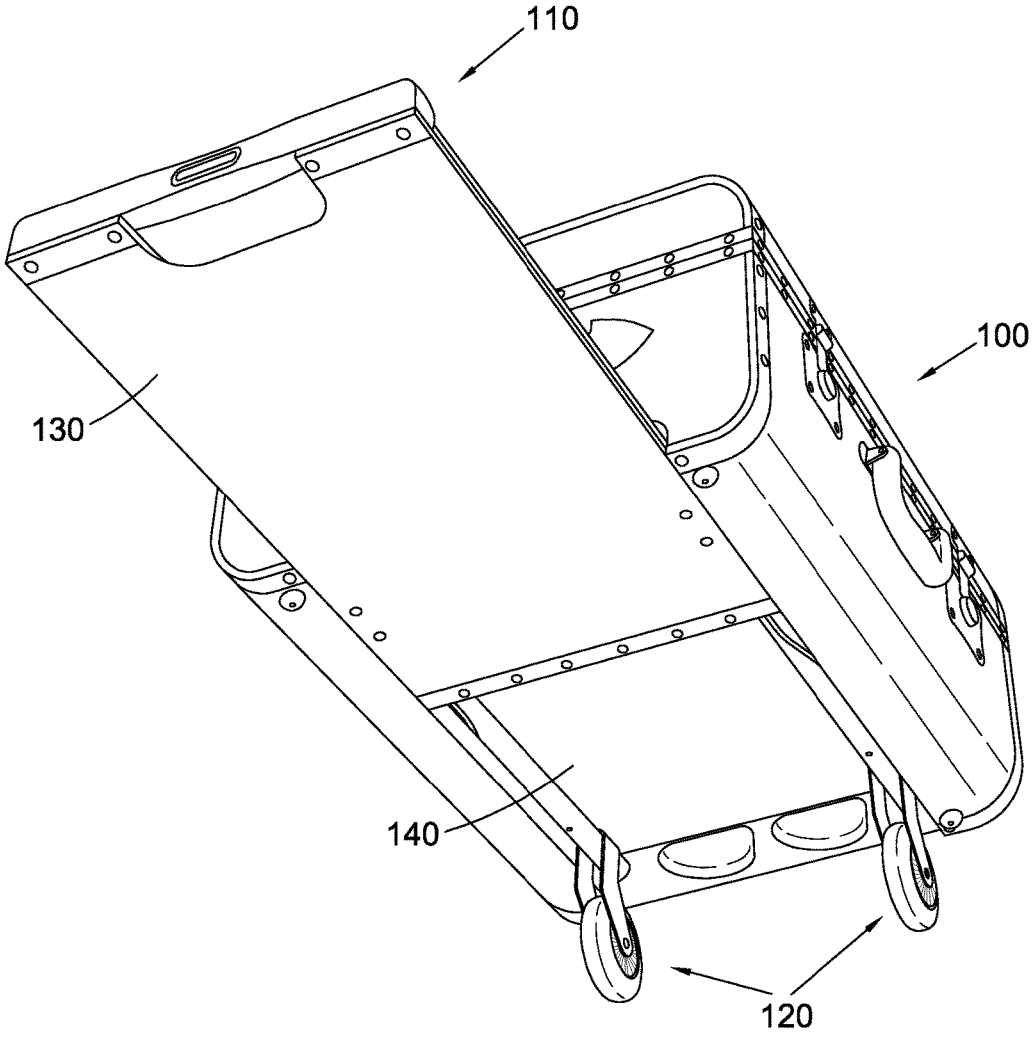
FIG. 2 is an underside perspective view of the luggage of FIG. 1.

FIG. 2 illustrates the underside of the luggage 100, and clearly shows the handle 110 comprising the cover 130 and the compartment or recess 140.

Figure 3:
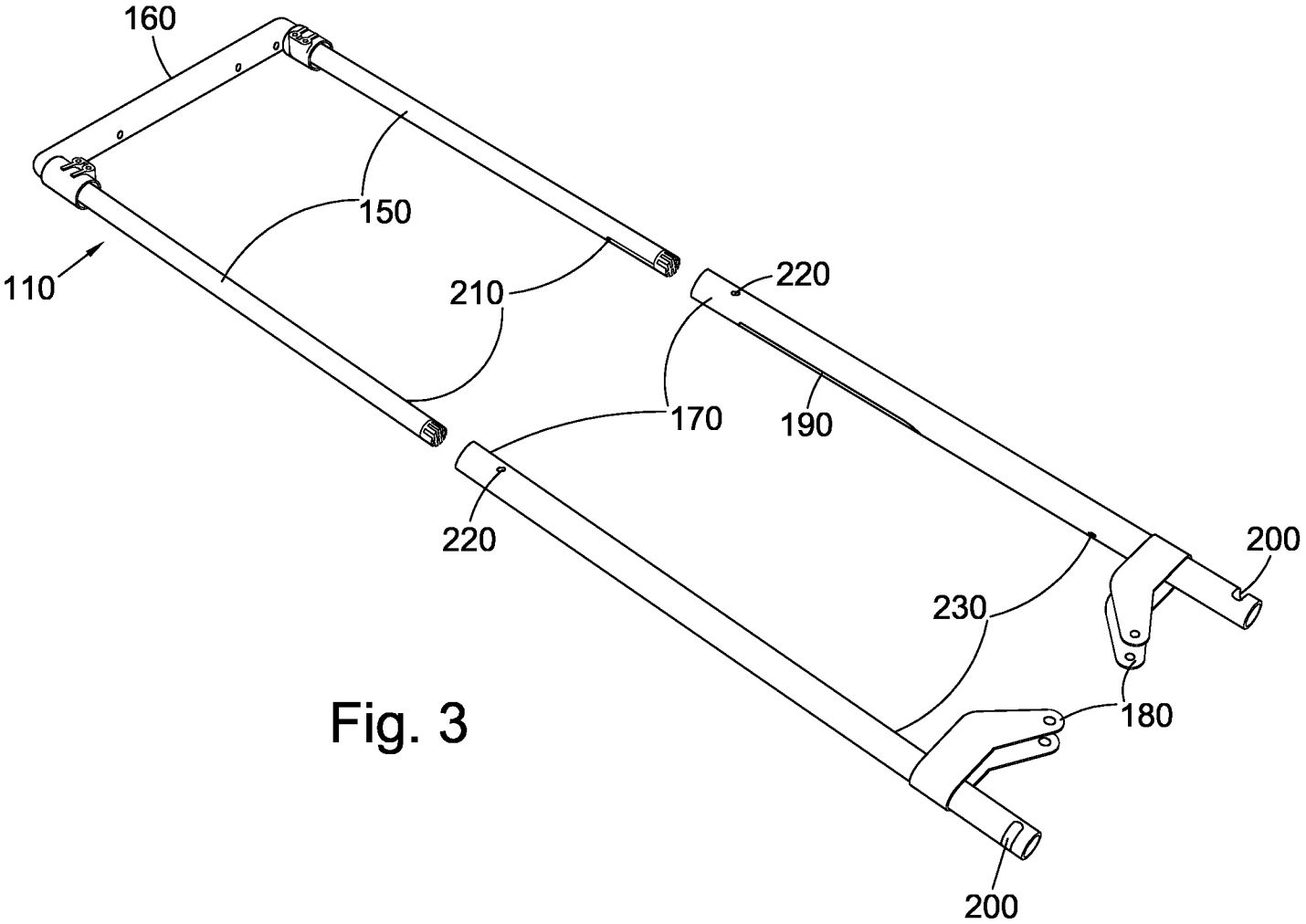
FIG. 3 is a perspective view of components of the mechanism of the present invention.

FIG. 3 shows the majority of the wheel retraction mechanism of the present invention. Handle 110 is shown without the cover 130, and is seen to comprise two substantially identical non-rotating members 150 (each defining a secondary member) interconnected by a crossbar 160 with an ergonomic grip which forms the portion of the handle 110 that the user holds. This crossbar could be made of plastic, composite or metal, and may be coated in textiles.

Non-rotating members 150 slide inside two rotating members 170 (each defining a primary member), each of which is connected to a wheel bracket 180 at its lower end (with the upper end being defined as that nearest the crossbar 160). Each rotating member 170 comprises a first actuation surface and first bearing surface comprising elongated slots: a first slot 190 and secondary slot 200 respectively. The first slot 190 is elongated and helically shaped, extending circumferentially around the rotating member 170 as it extends along its length. The first Slot 190 enables and actuates the rotation of rotating member 170. The secondary slot 190 is larger in diameter and much shorter. It does not extend along the longitudinal direction of the rotating member 170, but instead extends purely circumferentially. Both slots extend by a substantially identical angle in the circumferential direction.

A retractable pin 210 is present on the inside of each non-rotating member 150. This pin is controlled to withdraw against the action of a spring when a button on the crossbar 160 is depressed. In use these pins 210 are designed to engage with holes 220 and 230 when the non-rotating member is in an extended and retracted position respectively. These pin and hole pairs are used to lock the non-rotating member 150 with respect to the rotating member 170.

Figure 4:
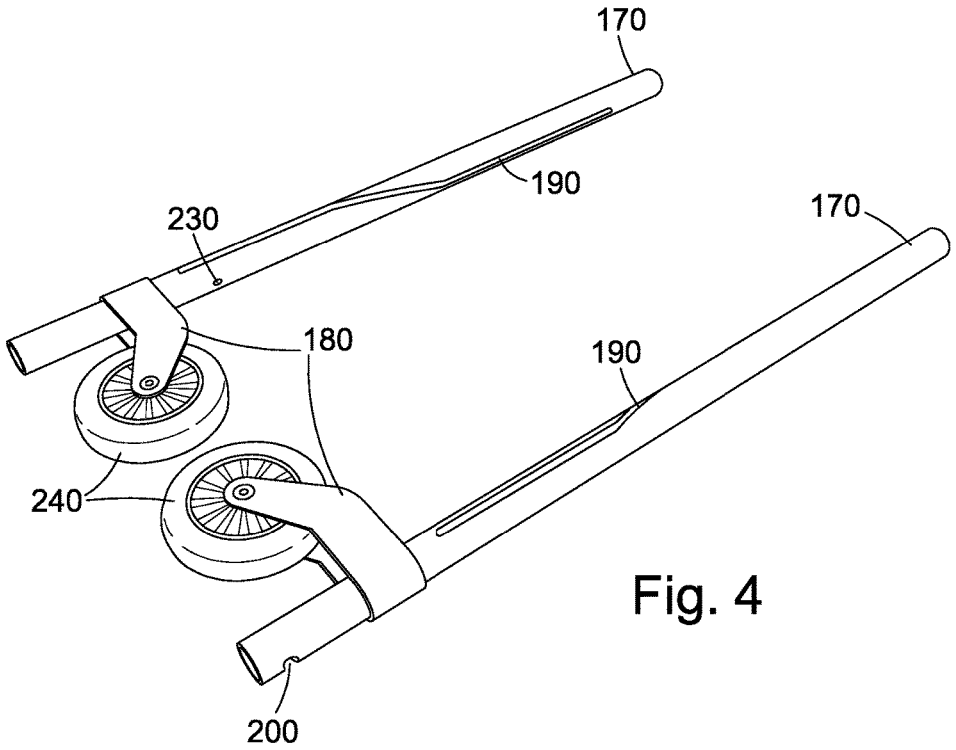
FIG. 4 is a perspective view of rotating members according to the present invention.
Figure 5:
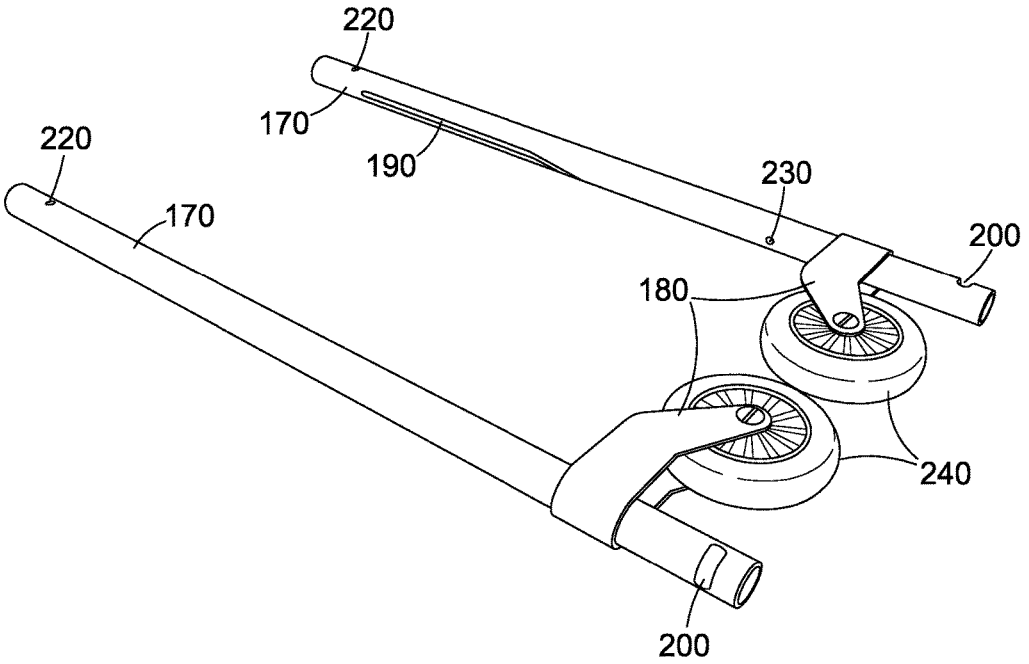
FIG. 5 is a further perspective view of rotating members according to the present invention.

FIGS. 4 and 5 depict the rotating members 170 with wheels 240 attached.

Figure 6:
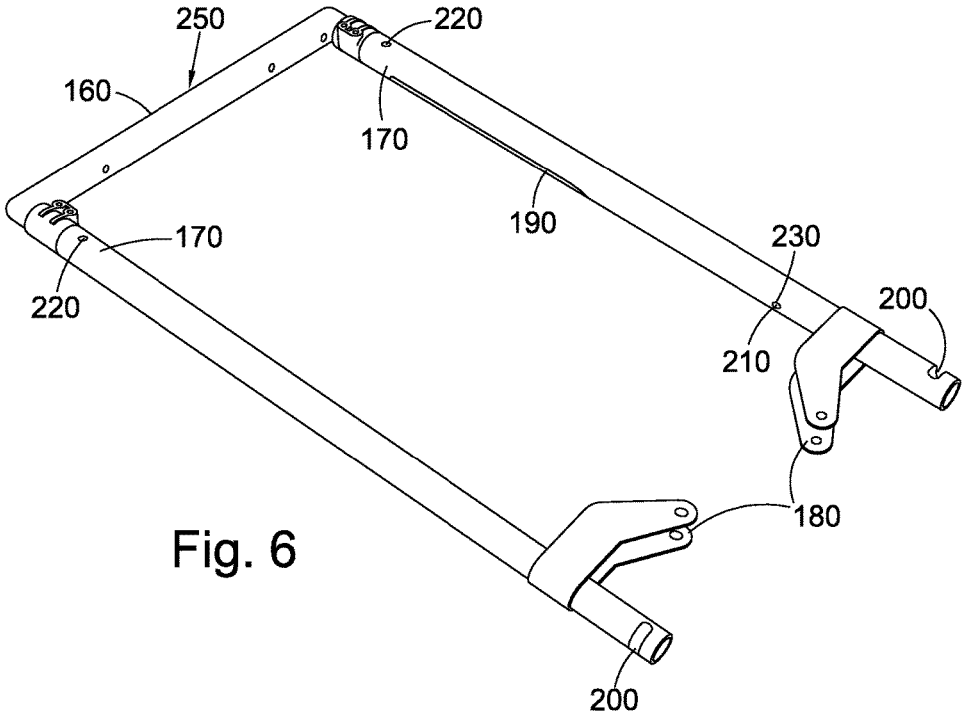
FIG. 6 is a perspective view of the present invention in a retracted position.

FIG. 6 shows the majority of the wheel retraction mechanism of the present invention in a retracted position. It can be seen that locking pins 210 have engaged holes 230. In order to retract the handle 110, thus withdrawing non-rotating members 150 from rotating members 170, button 250, located on crossbar 160, must first be pressed to withdrawn pin 210.

Figure 7:
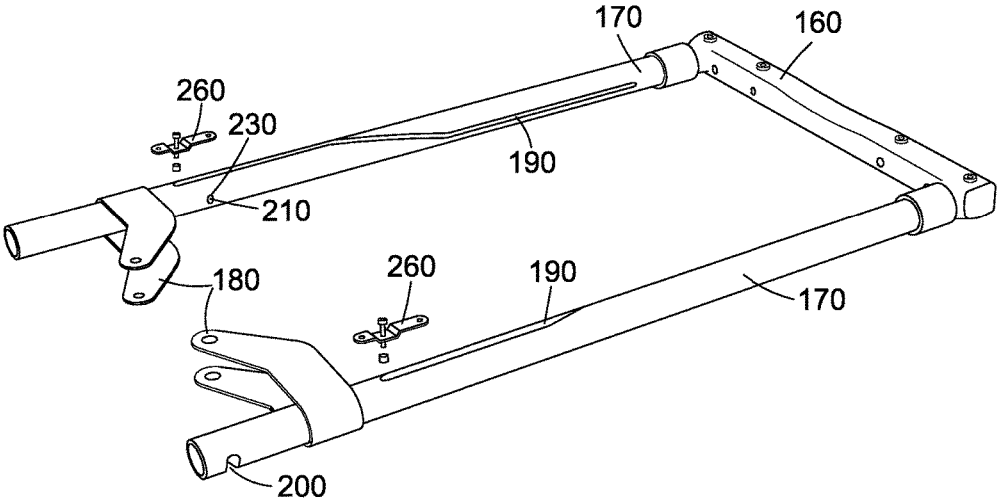
FIG. 7 is a further perspective view of the present invention in a retracted position.

FIG. 7 again depicts the wheel retraction mechanism in a retracted state, although with the inclusion of bracket assemblies 260. Bracket assemblies 260 extend through elongated slot 190 and rotating member 170 and attach to non-rotating member 150.

As the non-rotating members 150 are withdrawn from rotating members 170, the handle 160 prevents the non-rotating members from rotating. Due to the interaction of the first slot 190 and the bracket assemblies 260 (which are fixed to the non-rotating members 170 and so can also not rotate), the helical first slots 190 force the rotating members 170 to rotate. Rotating members 170 are therefore both rotated outwards, in a direction whereby both wheel brackets 180 end up pointing upwards (as viewed in FIG. 7) when the non-rotating members 150, and thus handle 110 is fully extended.

Figure 10:
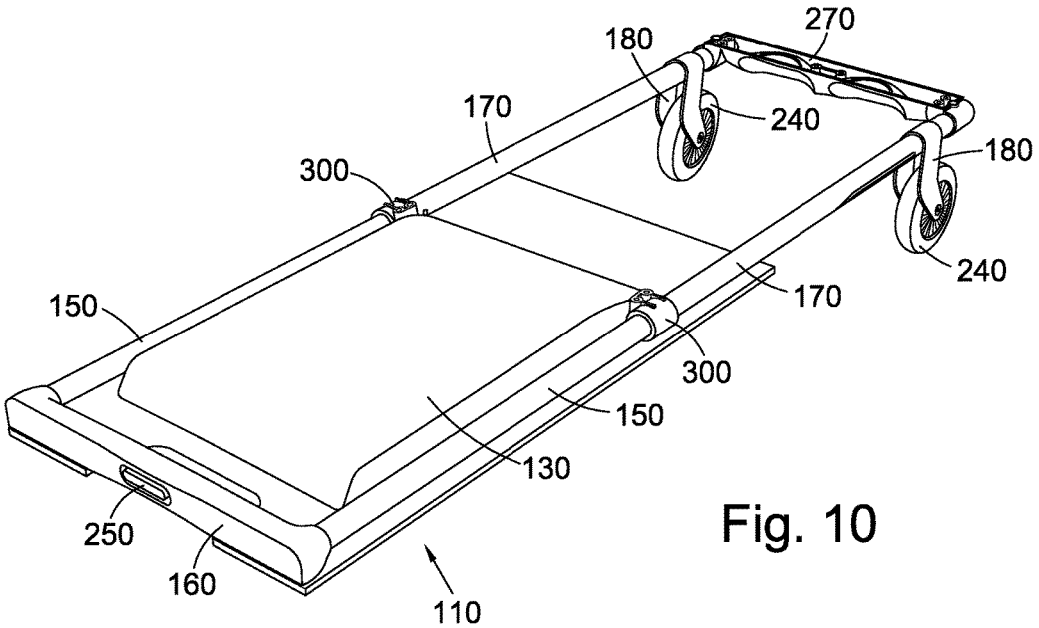
FIG. 10 is a perspective view of the present invention in an extended position.

FIG. 10 depicts the handle 110 in a fully extended position, although this figure depicts what is the underside in FIG. 10. When the handle is fully extended, the retractable pins 210 mate with holes 220. FIG. 10 also depicts supporting brackets 300. These brackets may contain bearings, and are also responsible for taking a proportion of the load as the luggage 100 is pulled by the handle 110. This prevents the entire pulling force being conveyed through the bracket assemblies 260 and first slots 190, reducing distortion, damage and wear.

Figure 8:
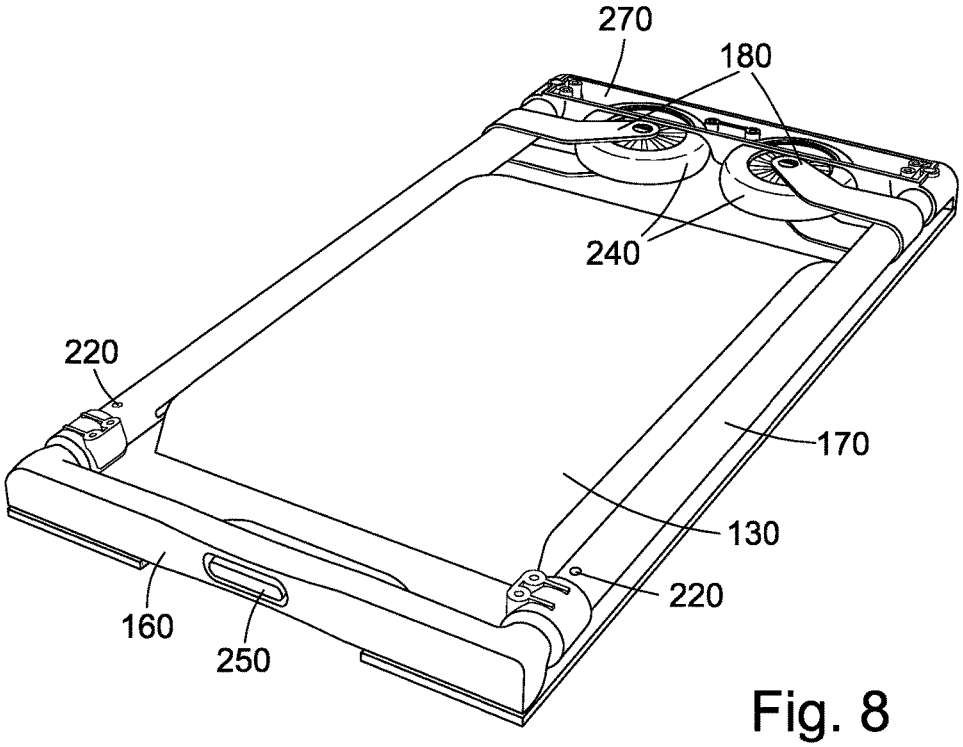
FIG. 8 is a further perspective view of the present invention in a retracted position.

FIG. 8 shows the wheel retraction mechanism in a fully retracted position. This figure illustrates the wheel housing unit 270, which in use is attached to the luggage 100. Additionally this figure highlights how the cover 130 totally covers and conceals both the wheels 240, and the rotating and non-rotating members 170, 150 with respect to the outside of the luggage in which the mechanism is contained.

Figure 9:
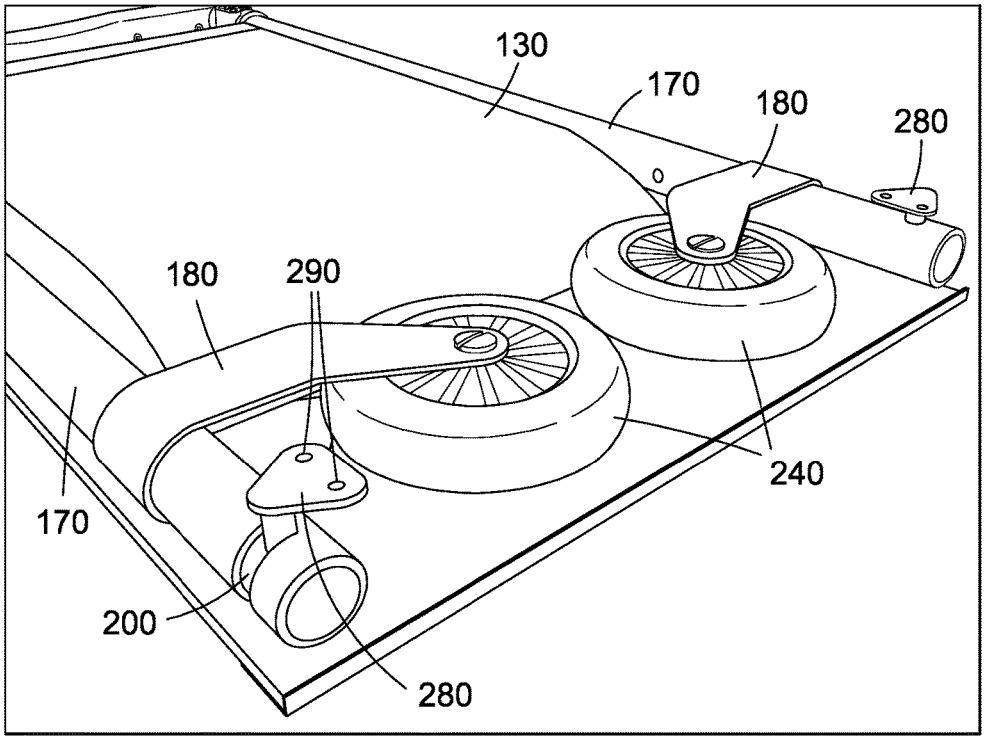
FIG. 9 is a further perspective view of the present invention in a retracted position.

FIG. 9 illustrates the same image as FIG. 8, but this time focussing on the retracted wheels 240. Also, load bearing projections 280 are shown which act as second bearing surfaces. Load bearing projections 280 are attached to the luggage 100 by screws or rivets attached via the plate holes 290 and the wheel housing 270.

Load bearing projections 280 mate with secondary slots 200. As the rotating member 170 rotates as the handle 110 is withdrawn or retracted, load bearing projections 280 move relatively along the length of secondary slots 200. As the handle 110, and thus wheels 240, reach their fully extended or retracted position, load bearing projection 280 abuts the end of secondary slot 200. Load bearing projection 280 and secondary slot 200 is the main weight transferring connection between the luggage and rotating member 170, thus it is robust in design.

Figure 11:
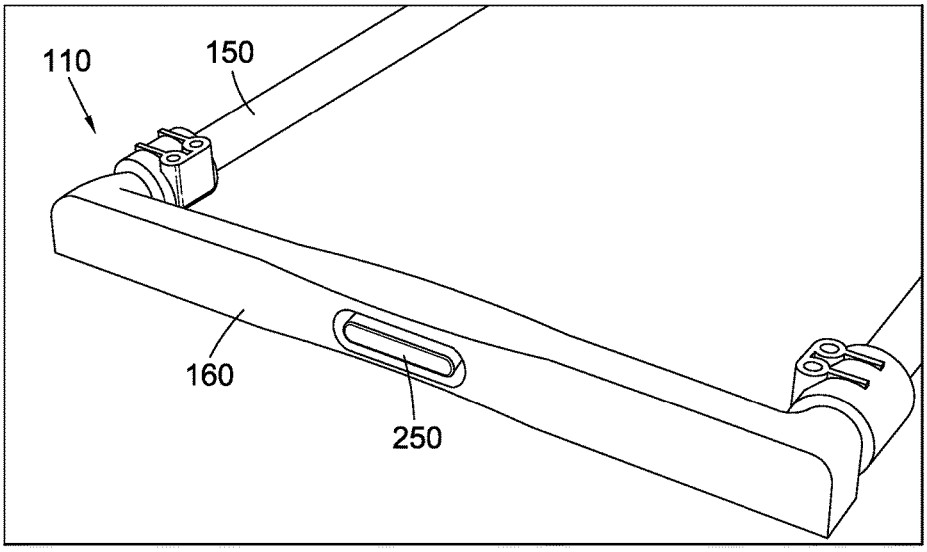
FIG. 11 is a perspective view of a part of the present invention.

FIG. 11 shows a close up of the crossbar section 160 of the handle 110 and illustrates the placement of the button 250.

Figure 12:
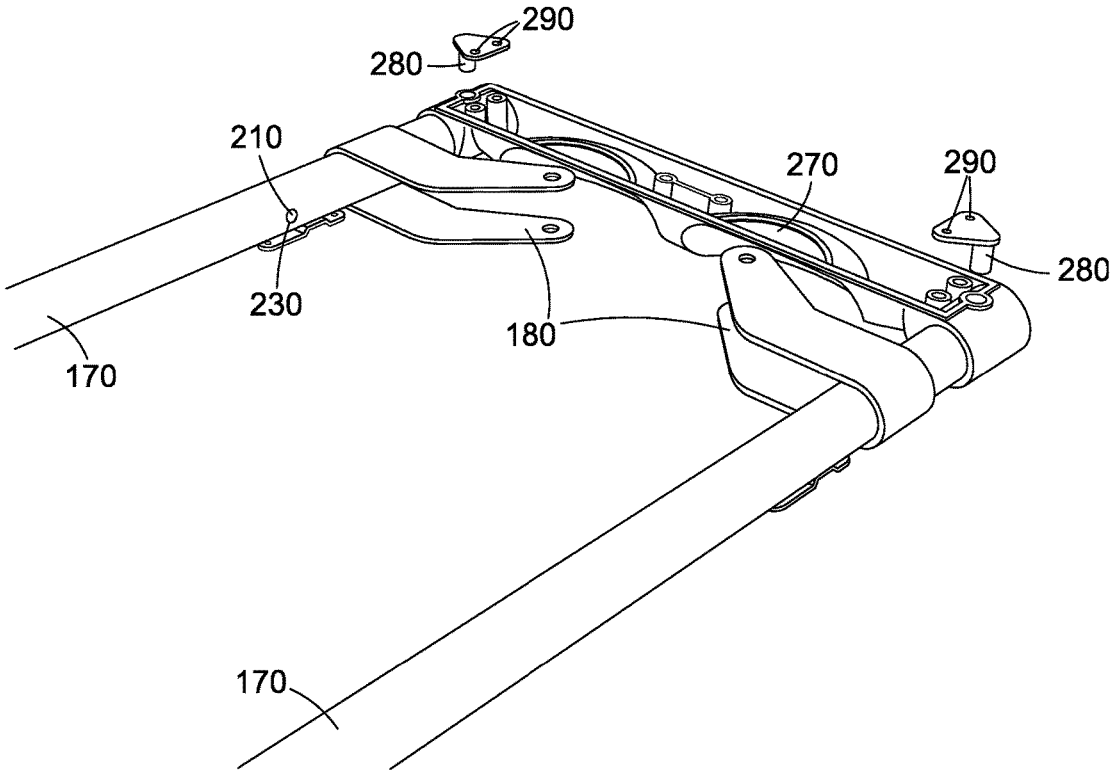
FIG. 12 is a perspective view of part of the present invention in a retracted position.

FIG. 12 shows a close up of the wheel-end of the rotating members 170. It illustrates how the load bearing projections 280 are attached to the wheel housing 270 via the load bearing projection plate holes 290. The wheels are shown partly absent to allow the details to be seen.

Figure 13:
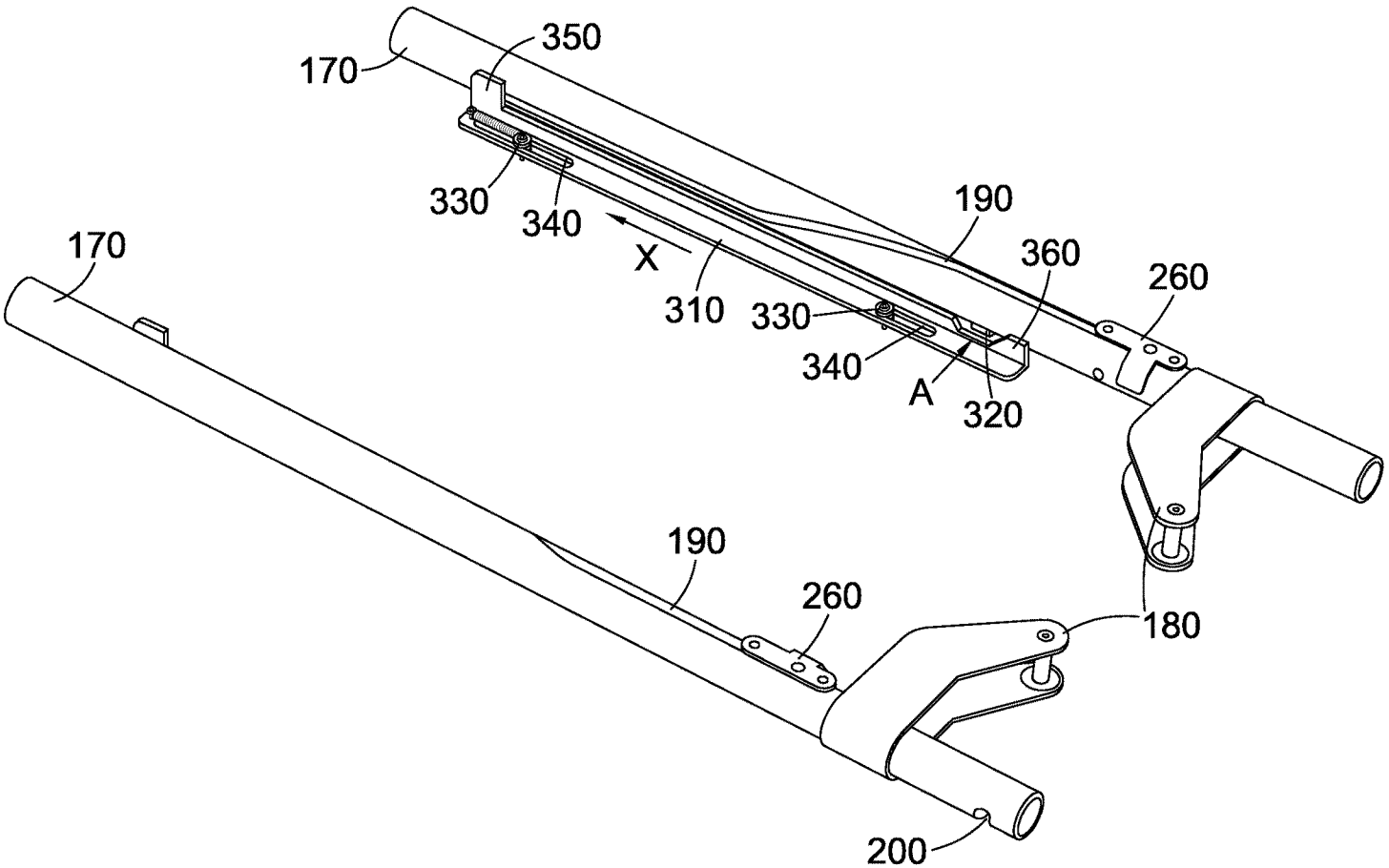
FIG. 13 is a perspective view of a further aspect of the present invention in a retracted position.
Figure 14:
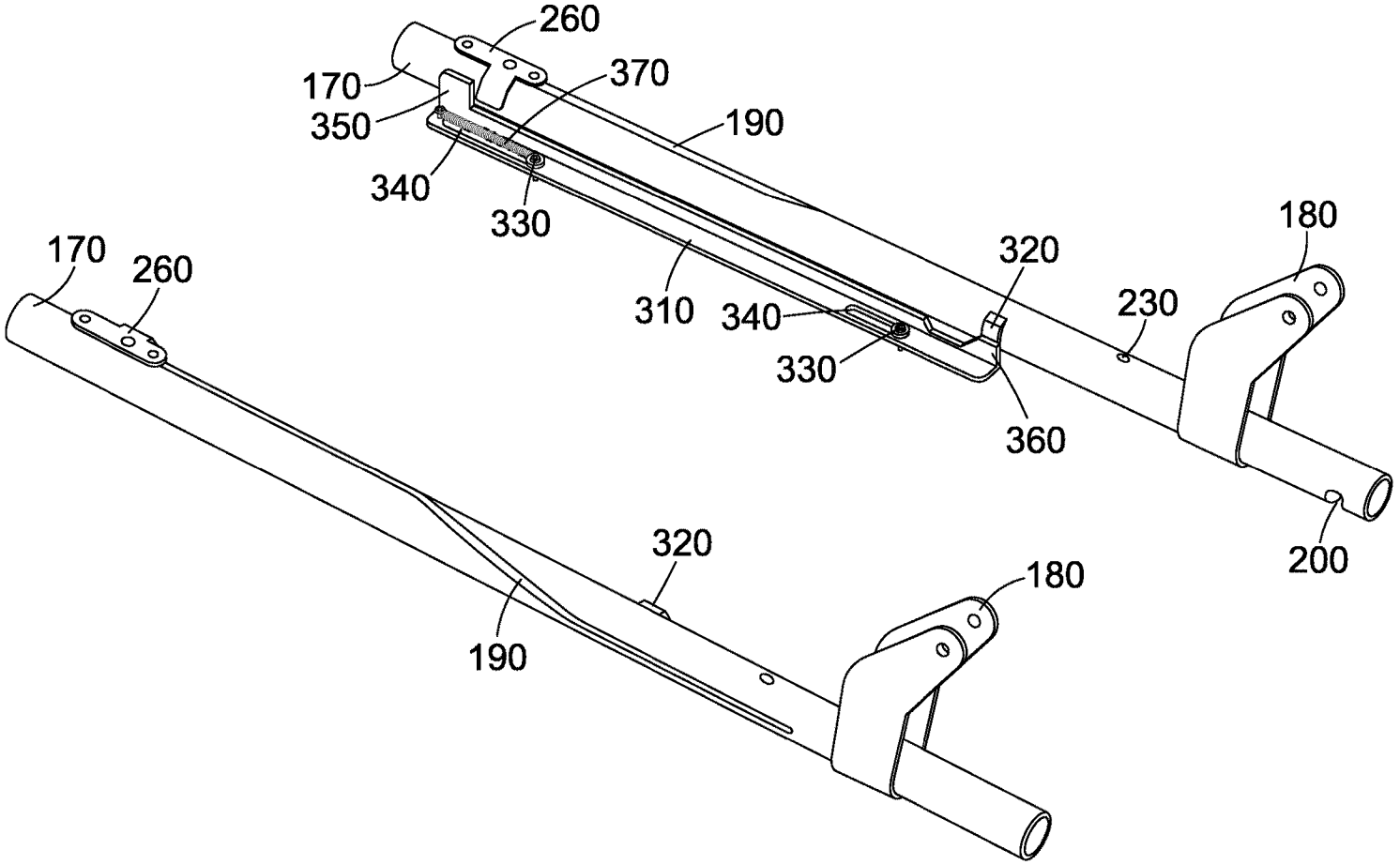
FIG. 14 is a perspective view of the aspect of FIG. 13 in an extended position.
Figure 15:
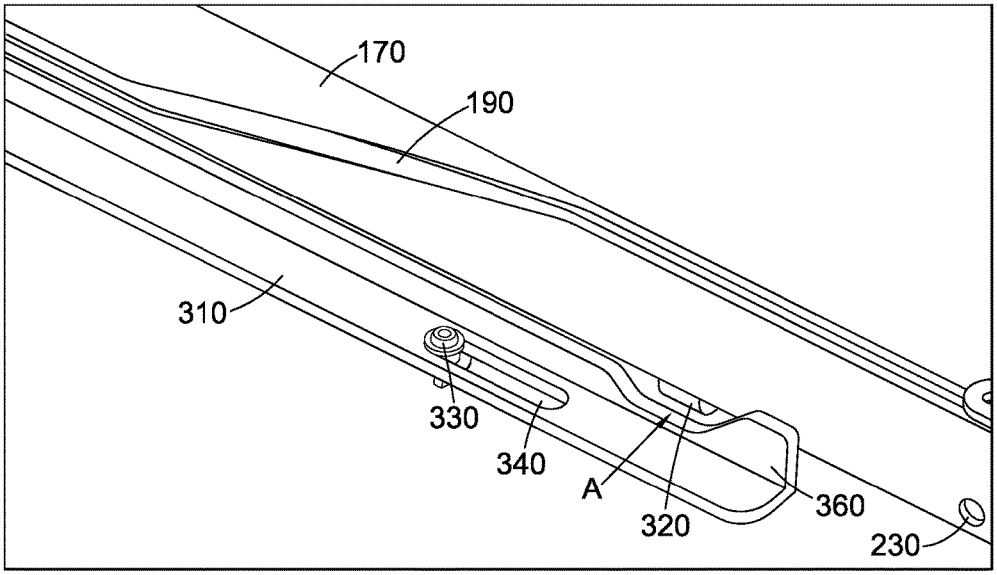
FIG. 15 is a partial view on an enlarged scale of FIG. 13.
Figure 16:
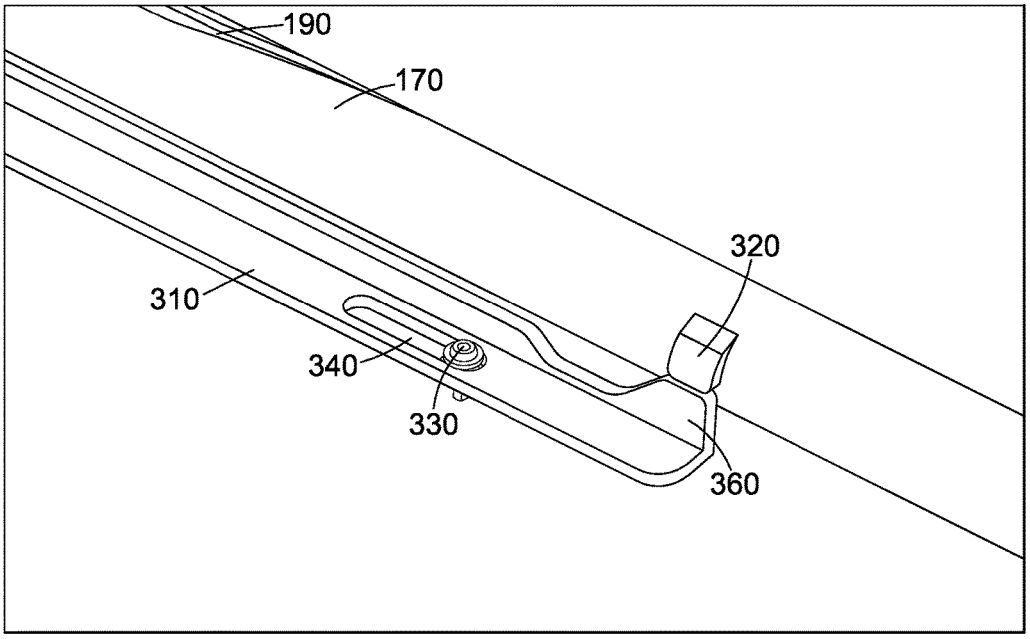
FIG. 16 is a partial view on an enlarged scale of FIG. 14.

FIGS. 13 to 16 show an embodiment of the reinforcement member 310. Reinforcement member 310 prevents the rotating member 170 from rotating in a retracting direction when it is locked in an extended position. FIGS. 13 and 15 show the reinforcement member 310 in a non-engaging state, when the wheels 240 are in a retracted state. FIGS. 14 and 16 depict the reinforcement member 310, when the wheels 240 are in an extended state, and thus the reinforcement member 310 engages a blocking projection 320 located on the rotating member 170.

Reinforcement member 310 is slidably attached to the luggage 100 by screws 330 located in slots 340. As the non-rotating member 150 is extended, the bracket assemblies 260 move along first slot 190, rotating the rotating member 170. As the bracket assemblies 260 approach the end of the first slot 190, they engage tab 350. Then, as the bracket assemblies 260 complete the final distance to reach the end of the first slot 190, reinforcement member 310 is moved in a direction "X". This locates the reinforcement member 310 in the position shown in FIGS. 14 and 16. Before reinforcement member 310 reaches this position, blocking projection 320 has rotated through gap A, thus when the reinforcement member 310 reaches the position shown in FIGS. 14 and 16, blocking projection 320 is located adjacent blocking panel 360.

When in this extended state, pin and holes 210 and 220 maintain the bracket assembly 260 in position, which in turn keeps the reinforcement member 310 in the position shown in FIGS. 14 and 16. In this position, blocking panel 360 prevents blocking projection 320 from passing, and thus prevents the rotating member 170 from rotating in a retracting direction. This produces a more robust system, since any bumps the wheels take on their side face when they are in the extended position, do not cause the wheels to distort or damage the bracket assembly 260 or first slot 190. The shock load is taken by the reinforcement member through blocking panel 360 and blocking projection 320.

Spring 370 is attached between the reinforcement member 310 and the screw 330 and pulls the reinforcement member 310 back towards the state shown in FIG. 13.

Figure 17:
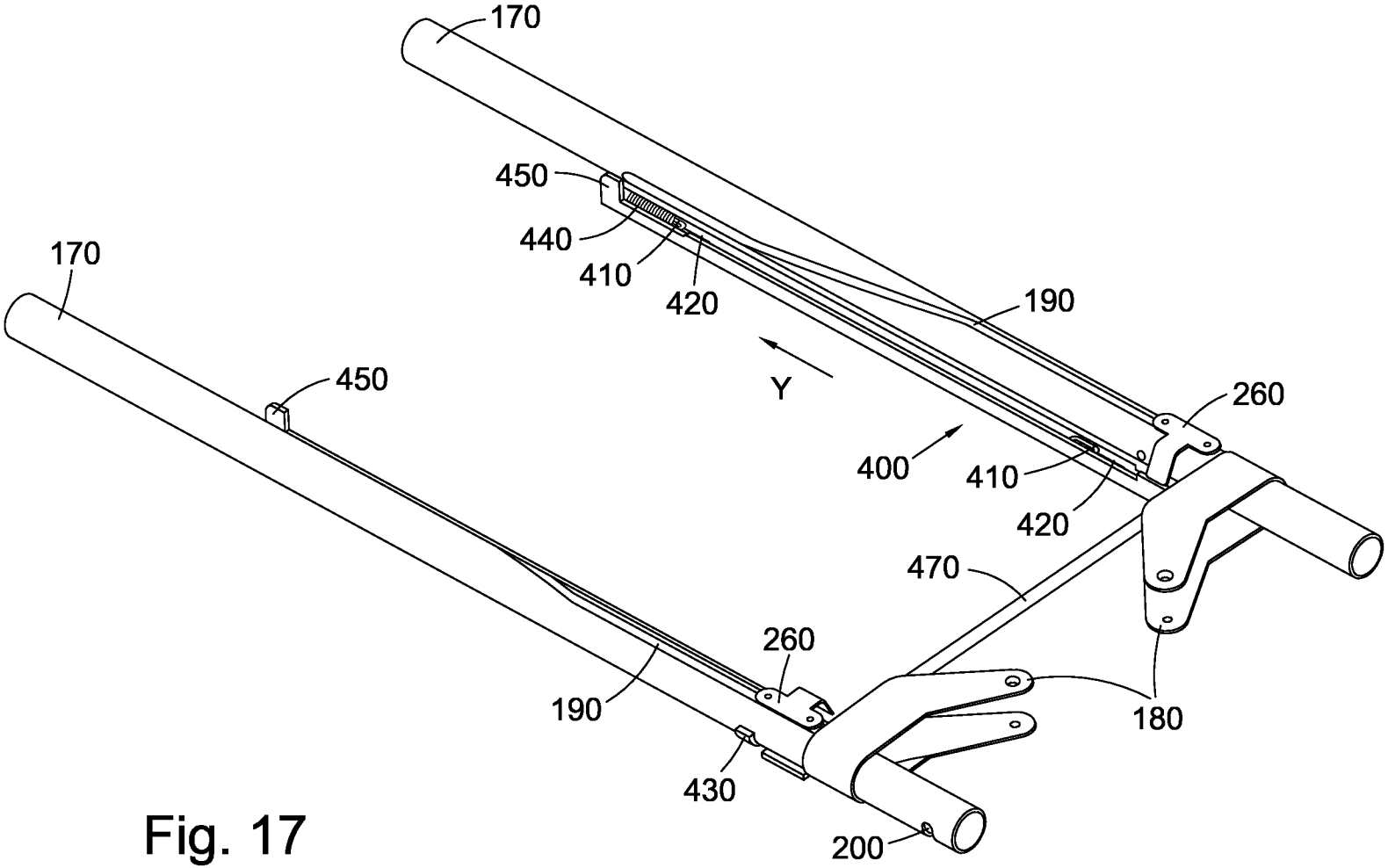
FIG. 17 is a perspective view of a second embodiment of an aspect of the present invention in a retracted position.
Figure 18:
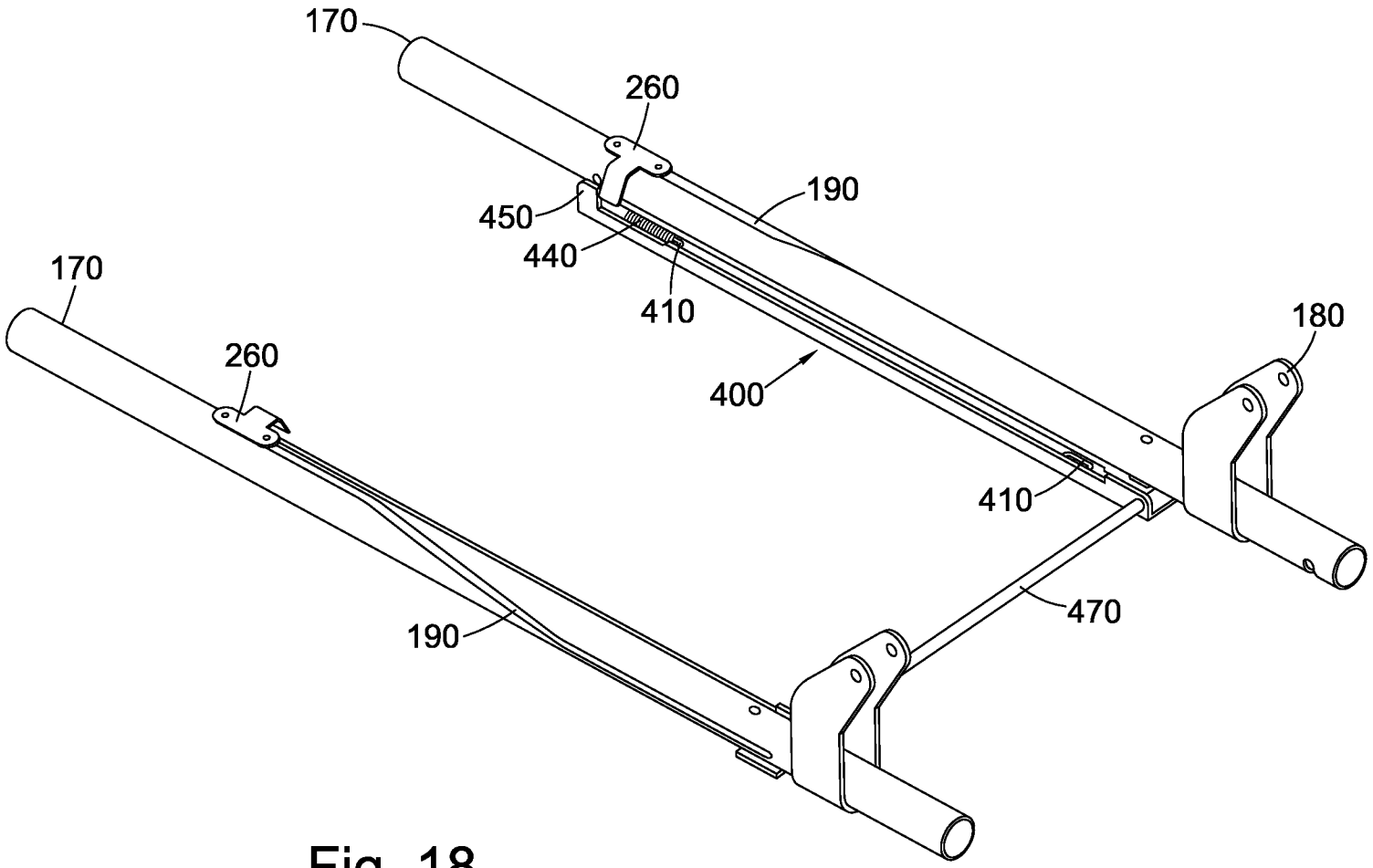
FIG. 18 is a perspective view of the aspect of FIG. 17 in an extended position.
Figure 19:
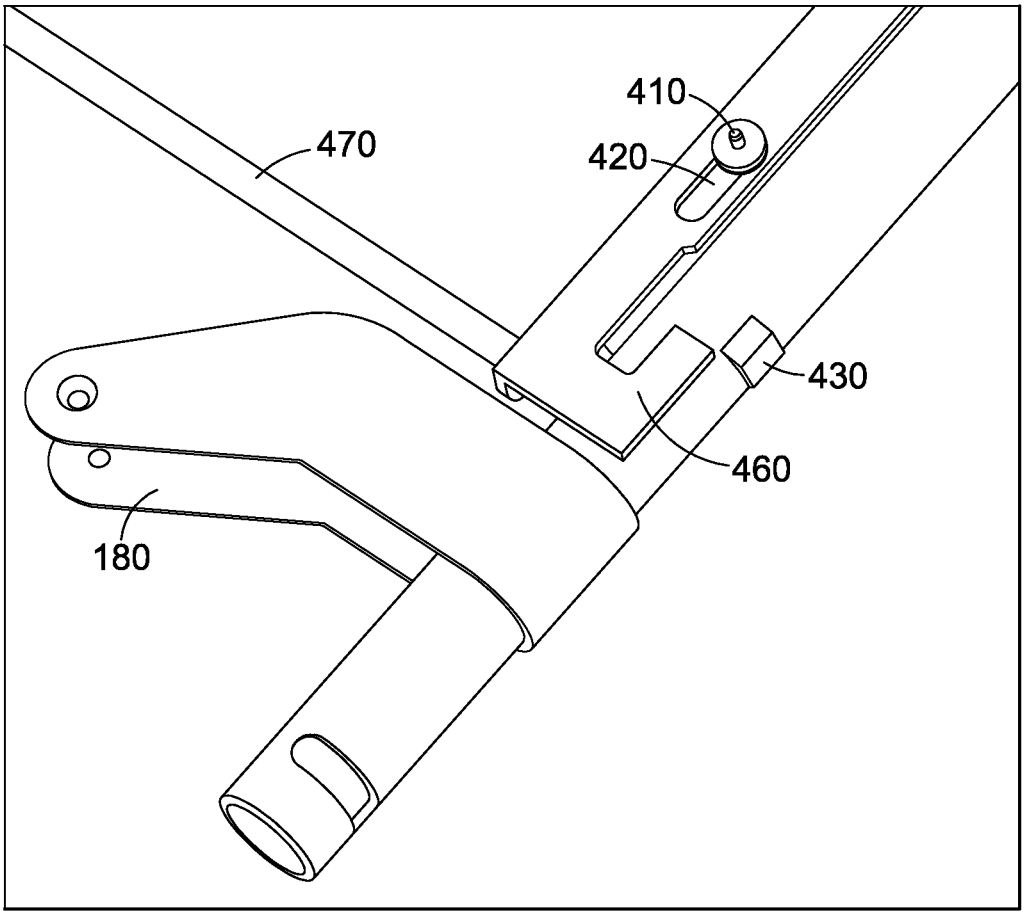
FIG. 19 is a partial, underside view on an enlarged scale of FIG. 17.
Figure 20:
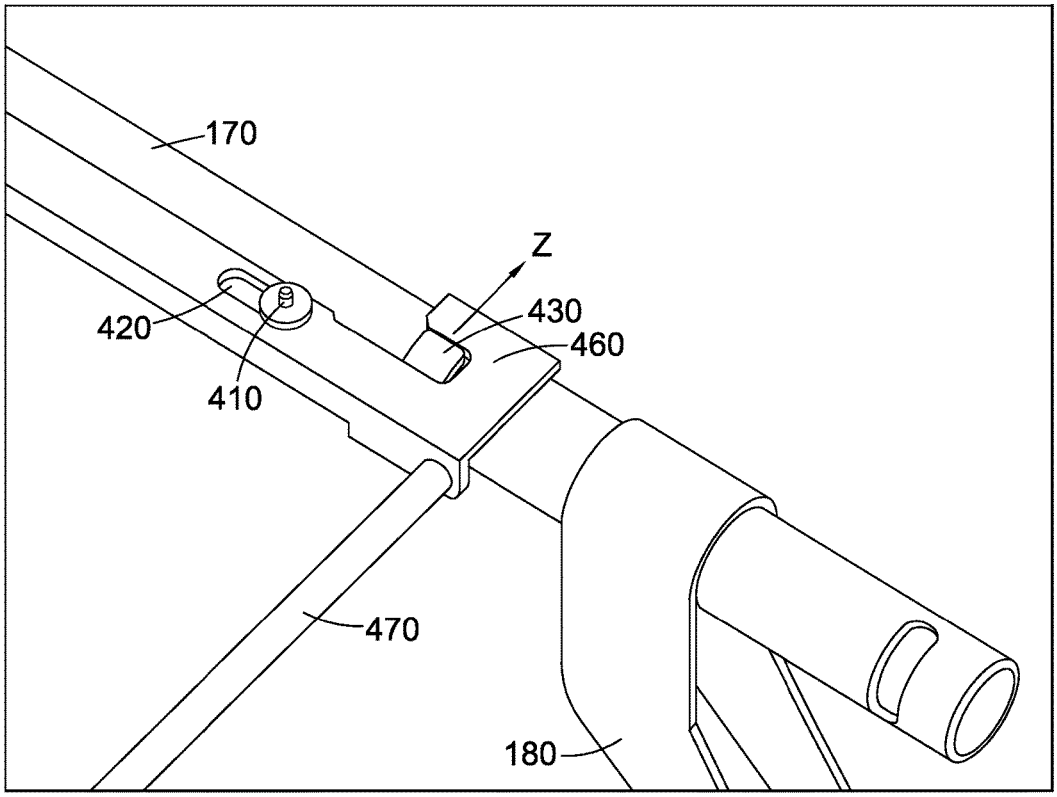
FIG. 20 is a partial, underside view on an enlarged scale of FIG. 18.

FIGS. 17 to 20 illustrate an alternative embodiment of a reinforcement member 400 according to some aspects of the present invention. Reinforcement members 400, located on either side of one panel/side of the luggage, prevent the rotating members 170 from rotating in a retracting direction when locked in an extended position. FIGS. 17 and 19 show a reinforcement member 400 in a non-engaging state—when the wheels 240 are retracted. FIGS. 18 and 20 show the reinforcement member in an engaging state—when the wheels 240 are extended; in this position, the reinforcement member 400 (and in particular an engaging panel) engages a blocking projection 430 located on the rotating member 170, preventing the rotating member 170 from rotating back to a retracted position.

The reinforcement member 400 is substantially an elongated bracket located parallel to the rotating members 170 and non-rotating members 150. The reinforcement member 400 is slidably attached to the luggage 100 by screws 410 in elongated slots 420. A spring 440 is connected between each reinforcement member 400 and the screw 410 located furthest from the wheel brackets 180, biasing the reinforcement member 400 into a retracted, or non-engaging, position.

Similar to the reinforcement member 310 embodiment depicted in FIGS. 13 to 16, reinforcement member 400 comprises a tab 450 located on the distal end of the reinforcement member 400. As the non-rotating member 150 is extended, the bracket assemblies 260 move along the first slot 190, rotating the rotating member 170. As the bracket assemblies 260 approach the end of the first slot 190, they engage the tab 450. Then, as the bracket assemblies 260 complete the final distance to reach the end of the first slot 190, reinforcement member 400 is moved in a direction "Y". This locates the reinforcement member 400 in the position shown in FIGS. 18 and 20.

The bracket assemblies 260 should be shaped so as to engage the tab 450.

The reinforcement member 400 comprises an engaging panel 460 located adjacent the wheel bracket end of the reinforcement member 400. The engaging panel 460 may lie in a plane substantially perpendicular to that of the tab 450. The engaging panel 460 may extend substantially parallel to the surface or panel of the luggage 100 to which the reinforcement member 400 is attached. The engaging panel 460 is substantially "L" shaped, extending out from the side of the reinforcement member 400. As such, the engaging panel 460 forms a shape similar to a square hook at its end.

A linking member 470 connects the two reinforcement members 400, located on either side of the luggage 100. The linking member 470 comprises a substantially cylindrical rod, rigidly attached to both reinforcement members 400 at either end.

A blocking projection 430 is located on the rotating member 170. The blocking projection 430 comprises a substantially rectangular protrusion, extending from the surface of the rotating member. The blocking projection 430 is in a position such that when each rotating member 170 and reinforcement member 400 are in an extended position, the engaging panel 460 engages the blocking projection 430.

As the bracket assemblies 260 force the reinforcement members 400 in a direction away from the wheel brackets 180, the engaging panels 460 are moved in to a position to substantially trap the blocking projection 430, as illustrated in FIG. 20. Due to the shape of the first slot 190, the blocking projection has already completed it's rotation into an extended position, before the bracket assemblies 260 move the engaging panels 460 into position, to engage the blocking projection 430. When in this extended state, pin and holes 210 and 220 maintain the bracket assembly 260 in position, which in turn keeps the reinforcement member 400 in the position shown in FIGS. 18 and 20. In this position, engaging panel 460 prevents blocking projection 430 from moving in a retracting-direction.

Unlike with the reinforcement member 310 of FIGS. 13 to 16, with the reinforcement member 400 of FIGS. 17 to 20, if the wheels 240 are forced in a retracting-direction due to an impact load, each blocking projection 430 exerts a force on the engaging panel 460 in a direction "Z", parallel to the panel of the luggage 100 to which the reinforcement member is attached. This is due to the arrangement of the contact between the blocking projection 430 and the engaging panel 460.

An arrangement such as that illustrated in FIGS. 17 to 20 results in the impact loads—transferred by the blocking projection 430 to the reinforcement member 400—acting in parallel and opposite directions on each reinforcement member 400. As such, there is no impact force transferred to the luggage 100 via the screws 410 due to the rotating members 170 attempting to move in a retracting-direction. The linking member 470 acts to connect the two reinforcement members 400, so that any impact loads (which would act to force the two reinforcement members 400 in opposite directions), can cancel each other out. This reduces the stresses experienced by the panel to which the reinforcement members 400 are connected, and thus increases reliability, robustness and durability of the luggage 100 as a whole.

It will be appreciated that it is not intended to limit the present invention to the above specific embodiments only. Many variants will be readily apparent to one of ordinary skill in the art without departing from the scope of the appended claims.

The invention claimed is:

1. A wheel retraction mechanism for wheeled travel luggage, comprising:

a primary member having a first actuation surface extending from or along a longitudinally extending surface of the primary member;

a secondary member, located substantially parallel to the primary member, the secondary member having a second actuation surface extending from or along a longitudinally extending surface of the secondary member; and at least one wheel, attached to the primary or the secondary member;

wherein the second actuation surface engages the first actuation surface and is shaped so it is able to slide along the length of the first actuation surface, and the first actuation surface is shaped whereby relative longitudinal motion between the primary and secondary members results in rotation of at least one of the primary and the secondary members about its longitudinal axis, and wherein the first actuation surface is a slot, and the second actuation surface is a projection for engaging the slot.

2. A wheel retraction mechanism according to claim 1, wherein at least one of the primary and secondary members are tubular and the first actuation surface is helically shaped around the length of the elongated surface of the primary member.

3. A wheel retraction mechanism according to claim 2, wherein the primary member and the secondary member are co-axial and one of the primary member or the secondary member is at least partially disposed within the other of the primary member or the secondary member.

4. A wheel retraction mechanism according to claim 2, wherein one of said primary member or said secondary member is a non-rotating member, and is unable to rotate about a longitudinal axis, and the other of said primary member or said secondary member is a rotating member and is free to rotate about its longitudinal axis.

5. A wheel retraction mechanism according to claim 4, wherein the at least one wheel is attached to said rotating member.

6. A wheel retraction mechanism according to claim 4, where upon movement of the second actuation surface along the length of the first actuation surface, said rotating member is rotated between a position where the wheel or wheels are fully extended and a position where the wheels are fully retracted.

7. A wheel retraction mechanism according to claim 6, wherein the rotation required to move the wheel or wheels from a fully extended to a fully retracted position is between 70-110 degrees.

8. A wheel retraction mechanism according to claim 3, wherein there is a sliding fit between the primary member and the secondary member.

9. A wheel retraction mechanism according to claim 3, wherein when the second actuation surface is located at a location corresponding to a retracted position, one of said primary or said secondary members is located almost wholly within the other of said primary member or said secondary member.

10. A wheel retraction mechanism according to claim 1, wherein the first actuation surface extends over at least half the length of the primary member.

11. A wheel retraction mechanism according to claim 1, wherein the first actuation surface extends over substantially the entire length of the primary member.

12. A wheel retraction mechanism according to claim 1, wherein a first end portion of the first actuation surface runs substantially parallel to the longitudinal axis of the primary or secondary member.

13. A wheel retraction mechanism according to claim 12, wherein the second end portion of the first actuation surface runs substantially parallel to the longitudinal axis of the primary or secondary member.

14. A wheel retraction mechanism according to claim 1, wherein a center portion of the first actuation surface has an increased angle with respect to the longitudinal direction compared to both the first and second end portions of the first actuation surface.

15. A wheel retraction mechanism according to claim 1, wherein the wheel retraction mechanism is attached to an item of travel luggage.

16. A wheel retraction mechanism according to claim 15, wherein the wheel retraction mechanism is attached to a side of the travel luggage which can be used as a base to rest the luggage on.

17. A wheel retraction mechanism according to claim 15, wherein the wheel retraction mechanism is attached to a side of the luggage adjacent the base and when in a wheel-extended position, the luggage can be leant on to the extended wheels to be transported.

18. A wheel retraction mechanism according to claim 15, wherein the wheel retraction mechanism is attached to a side of the travel luggage which is opposite an opening in the luggage.

19. A wheel retraction mechanism according to claim 15, wherein one of said primary member or said secondary member is a non-rotating member, and is unable to rotate about a longitudinal axis, and the other of said primary member or said secondary member is a rotating member and is free to rotate about its longitudinal axis; and wherein the rotating member is rotatably attached to the luggage.

20. A wheel retraction mechanism according to claim 1, wherein one of said primary member or said secondary member is a non-rotating member, and is unable to rotate about a longitudinal axis, and the other of said primary member or said secondary member is a rotating member and is free to rotate about its longitudinal axis, and wherein the or each wheel is attached to the rotating member by a bracket, which rotatably fixes the wheel or wheels relative to the rotating member a distance away from the longitudinal axis of the rotating member.

21. A wheel retraction mechanism according to claim 1, wherein one of said primary member or said secondary member is a non-rotating member, and is unable to rotate about a longitudinal axis, and the other of said primary member or said secondary member is a rotating member and is free to rotate about its longitudinal axis, and wherein the wheel retraction mechanism is attached to an item of travel luggage and wherein a reinforcing member is connected to the luggage and interacts with a locking projection on the rotating member when the rotating member is in the wheel-extended position, preventing the rotating member from rotating to a wheel-retracted position without the second actuation surface being moved relative to the first actuation surface.

22. A wheel retraction mechanism according to claim 21, wherein the reinforcing member is slidably attached to the luggage.

23. A wheel retraction mechanism according to claim 21, wherein the reinforcing member is moved by the second actuation surface or a bracket attached thereto, from a first position, wherein the locking projection does not interact with the reinforcing member when the rotating member is in a wheel-retracted position, to a second position, where the locking projection does interact with the reinforcing member when the rotating member is in a wheel-extended position.

24. A wheel retraction mechanism according to claim 23 wherein the reinforcing member is configured to slide from its second position to its first position under the action of a spring, as the second actuation surface moves along the first actuation surface, allowing the rotating member to rotate to a wheel-retracted position.

25. A wheel retraction mechanism according to claim 1, wherein one of said primary member or said secondary member is a non-rotating member, and is unable to rotate about a longitudinal axis, and the other of said primary member or said secondary member is a rotating member and is free to rotate about its longitudinal axis, and wherein at least one hole in either the rotating or non-rotating member engages with a retractable projection when the rotating member is in a wheel-retracted position, for locking the mechanism in this position.

26. A wheel retraction mechanism according to claim 25, wherein the retractable projection or retractable projections are configured to retract against the action of a spring.

27. A wheel retraction mechanism according to claim 25, wherein the retractable projection or retractable projections are configured to retract under the action of a button.

28. A wheel retraction mechanism according to claim 1, wherein one of said primary member or said secondary member is a non-rotating member, and is unable to rotate about a longitudinal axis, and the other of said primary member or said secondary member is a rotating member and is free to rotate about its longitudinal axis, and wherein at least one hole in either the rotating or non-rotating member engages with a retractable projection when the rotating member is in a wheel-extended position, for locking the mechanism in this position.

29. A wheel retraction mechanism according to claim 28, wherein the reinforcing member is moved by the second actuation surface or a bracket attached thereto, from a first position, wherein the locking projection does not interact with the reinforcing member when the rotating member is in a wheel-retracted position, to a second position, where the locking projection does interact with the reinforcing member when the rotating member is in a wheel-extended position and wherein the at least one hole and retractable projection are for fixing the relative positions of the rotating remember and the non-rotating member, thus can maintain the second actuation surface in a position where it keeps the reinforcing member in its second position, in which it engages the locking projection.

30. A wheel retraction mechanism according to claim 1, wherein the second actuation surface is cylindrical in shape.

31. A wheel retraction mechanism according to claim 1, wherein the second actuation surface is detachable from the secondary member.

32. A wheel retraction mechanism according to claim 1, wherein the second actuation surface is screwably detachable from the secondary member.

33. An apparatus comprising two or more wheel retraction mechanisms according to claim 1 attached to a common component, wherein one of said primary member or said secondary member of each wheel retracting mechanism is a non-rotating member, and is unable to rotate about a longitudinal axis, and the other of said primary member or said secondary member of each wheel retracting mechanism is a rotating member and is free to rotate about its longitudinal axis, and wherein said non-rotating members are interconnected and thus unable to rotate along their longitudinal axes.

34. An apparatus according to claim 33, wherein the common component acts as a handle for the user.

35. An apparatus according to claim 33 wherein the retractable projection or retractable projections of the two or more wheel retraction mechanisms are configured to retract under the action of a button, and wherein the handle comprises the button for retracting the retractable projections.

36. An apparatus according to claim 33, wherein the common component is a cover.

37. An apparatus according to claim 36, wherein the cover acts to conceal and protect the wheels when in a retracted position.

38. A wheel retraction mechanism for wheeled travel luggage, comprising:

a primary member having a first actuation surface extending from or along a longitudinally extending surface of the primary member;

a secondary member, located substantially parallel to the primary member, the secondary member having a second actuation surface extending from or along a longitudinally extending surface of the secondary member;

at least one wheel, attached to the primary or the secondary member;

wherein the second actuation surface engages the first actuation surface and is shaped so it is able to slide along the length of the first actuation surface, and the first actuation surface is shaped whereby relative longitudinal motion between the primary and secondary members results in rotation of at least one of the primary and the secondary members about its longitudinal axis;

wherein one of said primary member or said secondary member is a non-rotating member, and is unable to rotate about a longitudinal axis, and the other of said primary member or said secondary member is a rotating member and is free to rotate about its longitudinal axis, and wherein the wheel retraction mechanism is attached to an item of travel luggage and wherein a first bearing surface is provided in one of the rotating or non-rotating members, the first bearing surface engaging a second bearing surface provided in the luggage or a fitting attached thereto for transferring load in a direction parallel to the longitudinal direction of the rotating and non-rotating members.

39. A wheel retraction mechanism according to claim 38, wherein the first bearing surface is located in the rotating member.

40. A wheel retraction mechanism according to claim 39, wherein the first bearing surface and second bearing surface transfer the majority of the load of the luggage to the rotating member.

41. A wheel retraction mechanism according to claim 38, wherein the first bearing surface comprises a load-transferring slot and the second bearing surface comprises a load-transferring projection.

42. A wheel retraction mechanism according to claim 41, wherein the load-transferring slot is orientated in a circumferential direction of the rotating member.

43. A wheel retraction mechanism according to claim 38, wherein the second bearing surface is configured to slide substantially along the length of the first bearing surface as the rotating member rotates between its wheel-extended and wheel-retracted position.

44. A wheel retraction mechanism according to claim 38, wherein the second bearing surface abuts a surface of the first bearing surface when the rotating member is in its wheel-extended position, preventing the rotating member from rotating any further.

45. A wheel retraction mechanism according to claim 38, wherein the first and second bearing surfaces only engage each other as the wheels approach a fully wheel-extended position.

* * * * *